US006227574B1

(12) United States Patent
Fischer

(10) Patent No.: US 6,227,574 B1
(45) **Date of Patent: *May 8, 2001**

(54) FORM WITH INTEGRATED CARD

(75) Inventor: Jules Fischer, Widen (CH)

(73) Assignee: Fofitec AG, Dottikon (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/993,037

(22) Filed: Dec. 18, 1997

(30) Foreign Application Priority Data

Dec. 18, 1996 (CH) ..... 3102/96
Jun. 2, 1997 (EP) ..... 97810337

(51) Int. Cl.[7] ..... B42D 15/00
(52) U.S. Cl. ..... 283/105; 283/61; 283/62
(58) Field of Search ..... 229/92.8, 207; 283/61, 62, 75, 76, 77, 78; 462/6, 7, 8; 428/132, 136, 140

(56) References Cited

U.S. PATENT DOCUMENTS 3,608,816 * 9/1971 Neubauer ..... 229/69
4,429,828 * 2/1984 Farber ..... 229/75
4,889,749 * 12/1989 Ohashi et al. ..... 428/13
5,039,652 * 8/1991 Doll et al. ..... 503/206
5,074,593 * 12/1991 Grosso ..... 283/77
5,108,346 * 4/1992 Ashby ..... 462/6
5,403,236 * 4/1995 Greig ..... 462/6
5,589,025 * 12/1996 Garrison ..... 156/268
5,632,511 * 5/1997 Longtin et al. ..... 283/62
5,770,288 * 6/1998 Carney, Jr. ..... 428/40.1
5,839,763 * 11/1998 McCannel ..... 283/109

* cited by examiner

*Primary Examiner*—Willmon Fridie, Jr.
(74) *Attorney, Agent, or Firm*—Morgan, Lewis & Bockius LLP

(57) ABSTRACT

The form (1) is distinguished in that the integrated detachable card (2) is connected to the material surrounding it at least partly along its external margin in the form by an as [sic] bridge, the material thickness along the bridge being continuously less than the overall thickness of the form. The bridge is preferably formed by a part layer (9), all the remaining part layers (10–13) being severed. The card can be constructed simply, with plastification on one or both sides, as a vignette and/or as a so-called butterfly card. In addition, it may also be part of a self-adhesive label or may contain one.

23 Claims, 24 Drawing Sheets

FIG. 11d
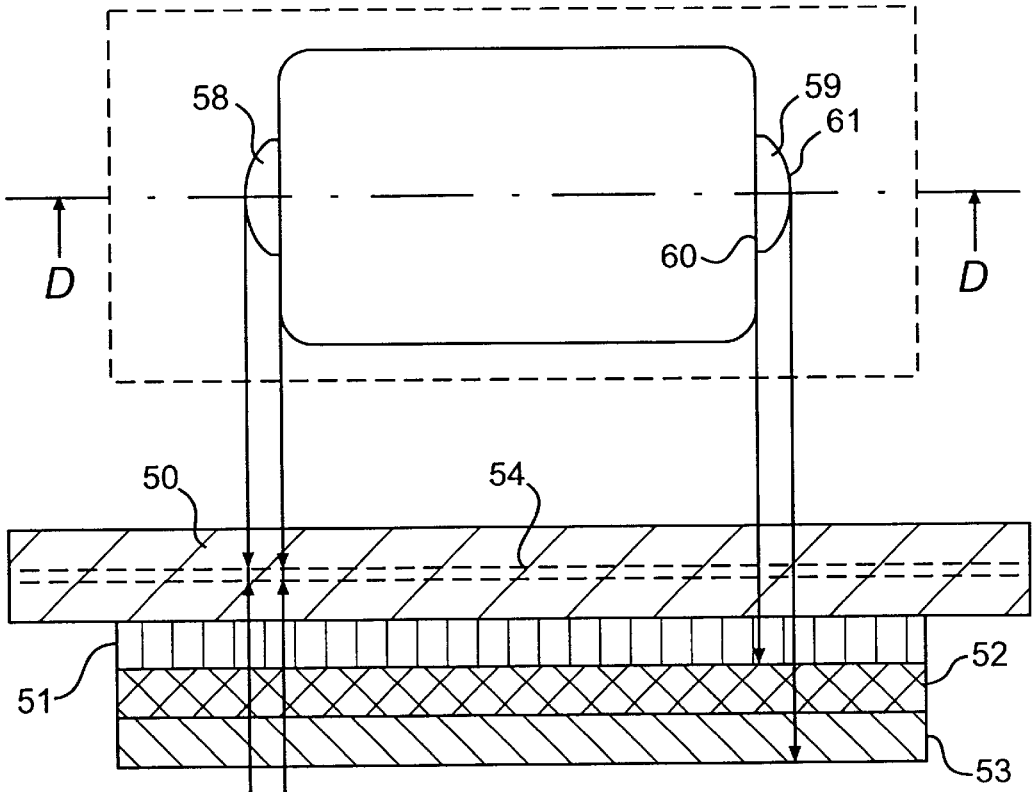
FIG. 11e
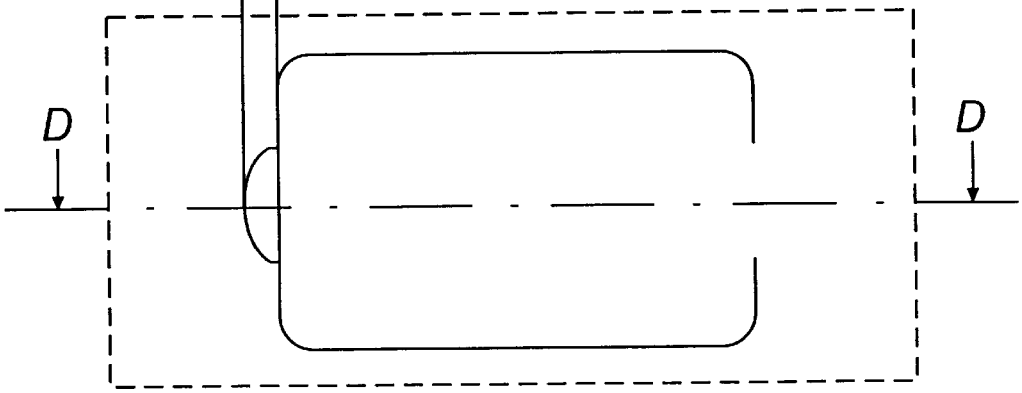
FIG. 11f

FIG. 13d
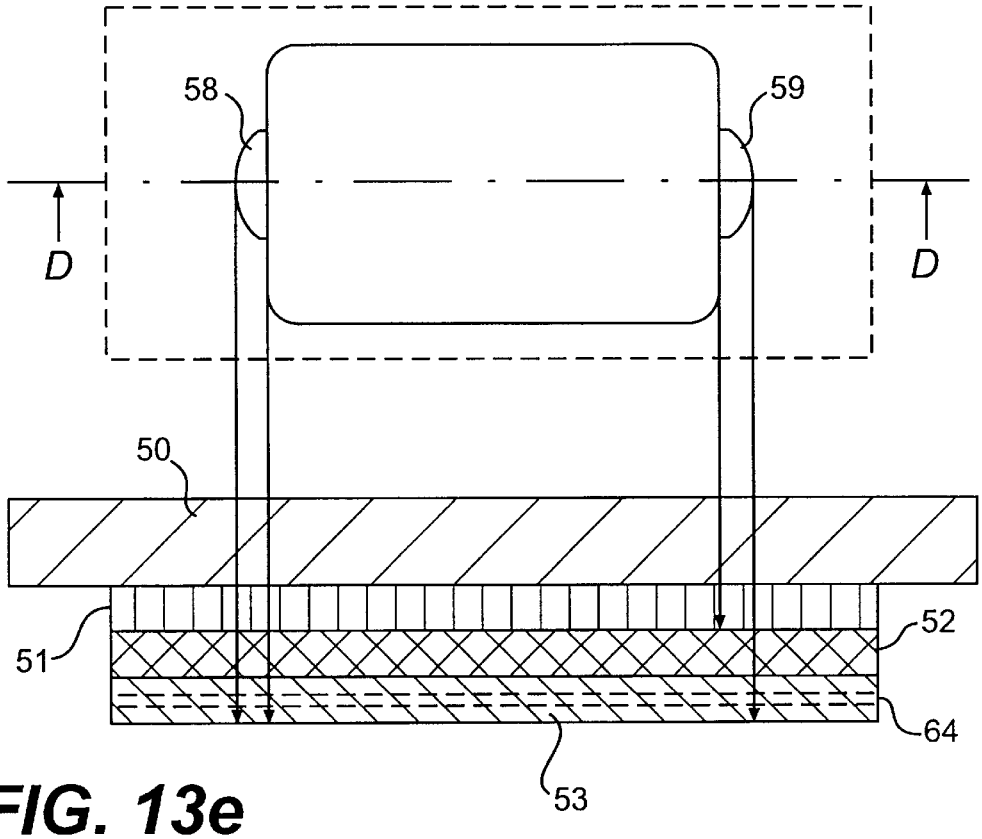
FIG. 13e
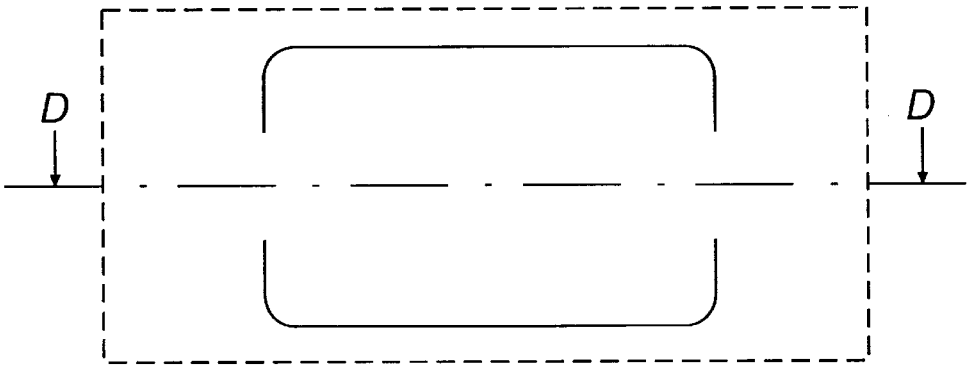
FIG. 13f

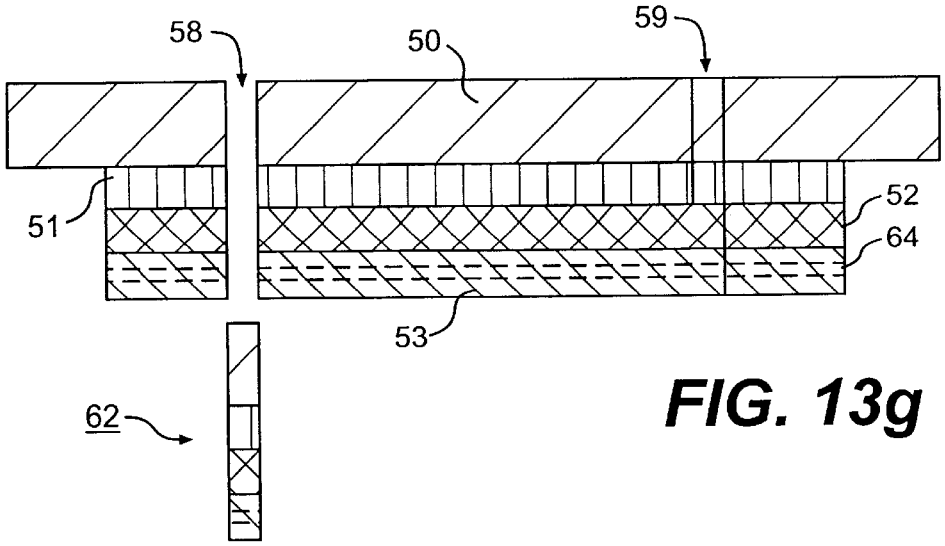
FIG. 13g
FIG. 13h
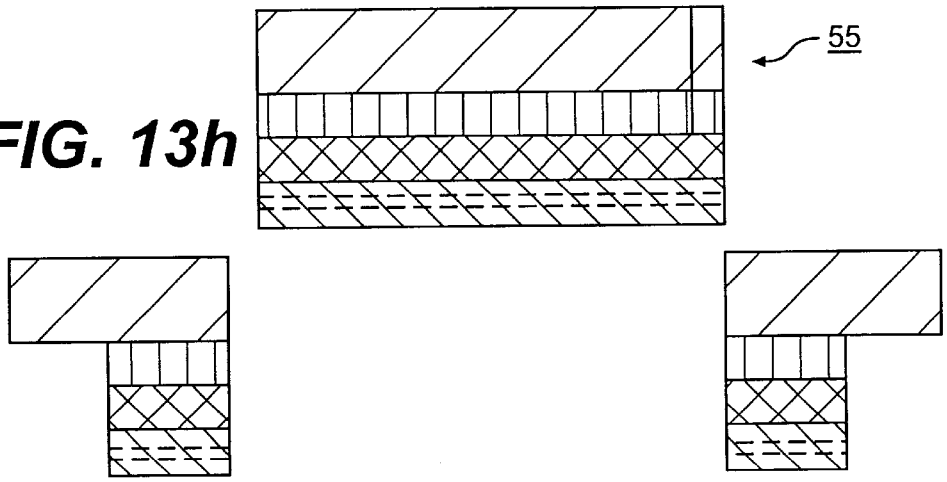
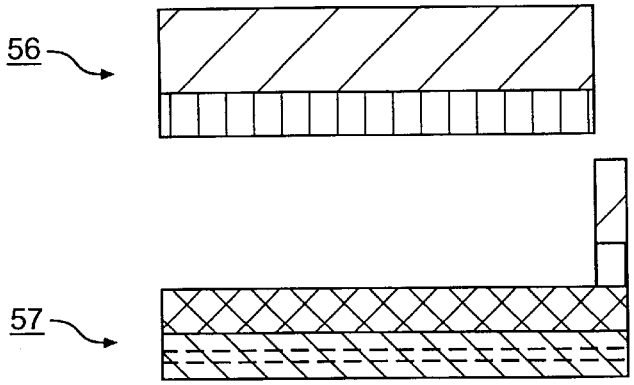
FIG. 13i

FIG. 14d
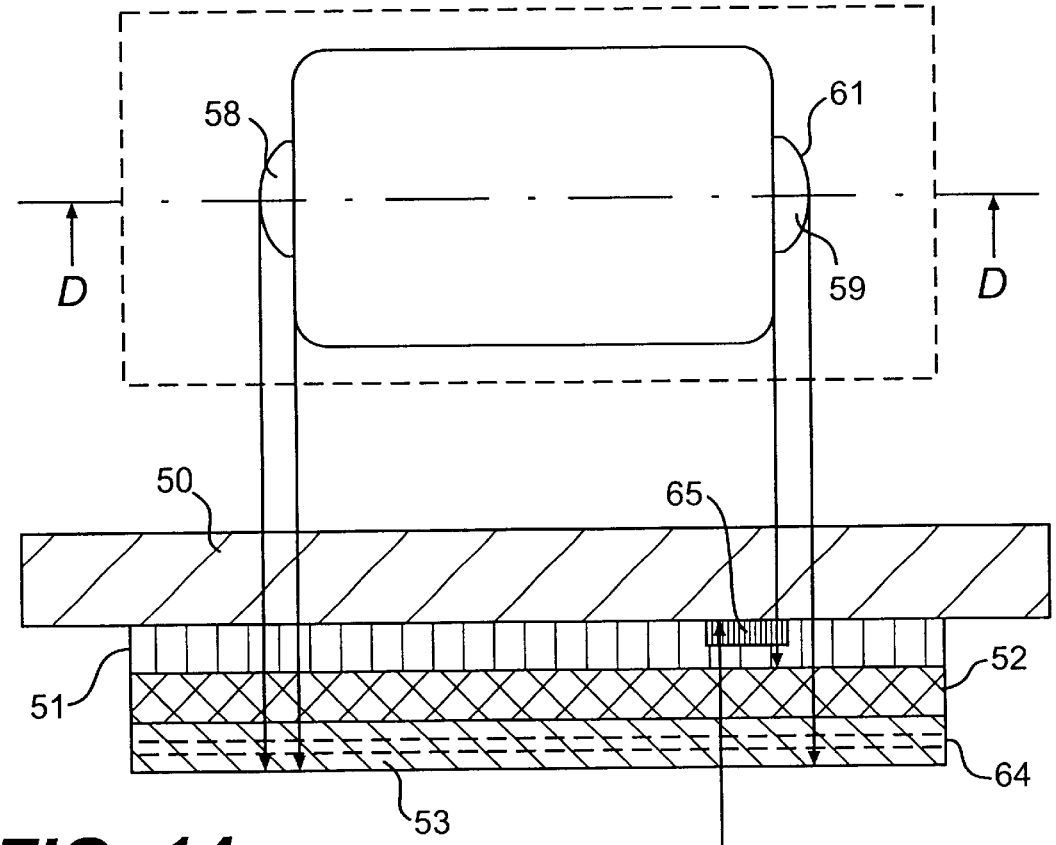
FIG. 14e
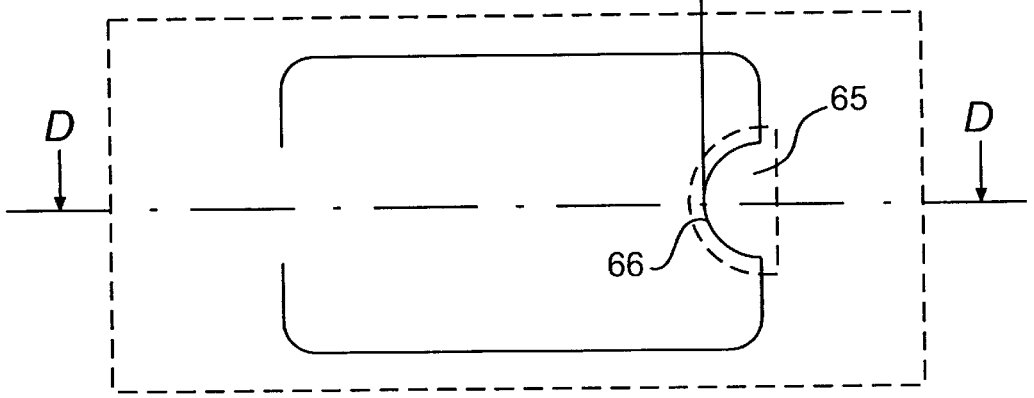
FIG. 14f

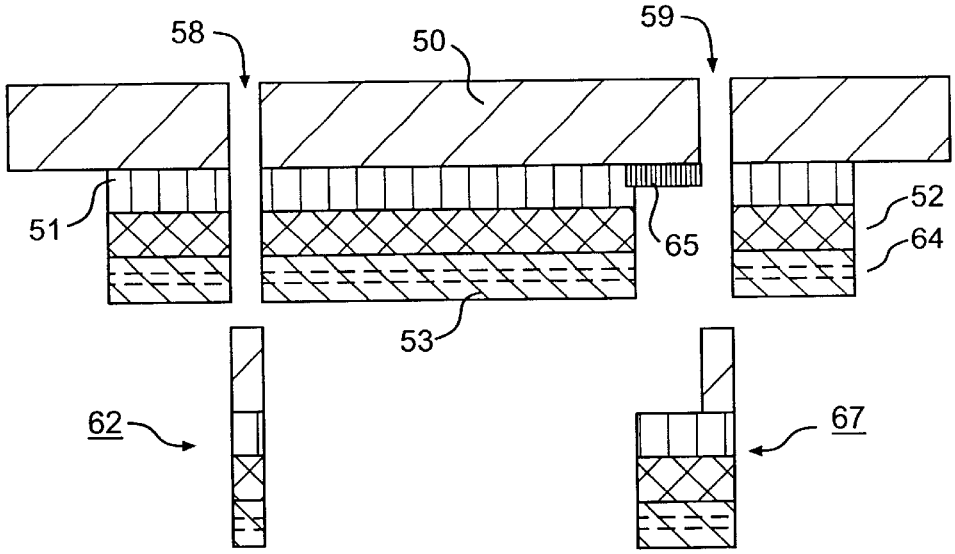
FIG. 14g
FIG. 14h
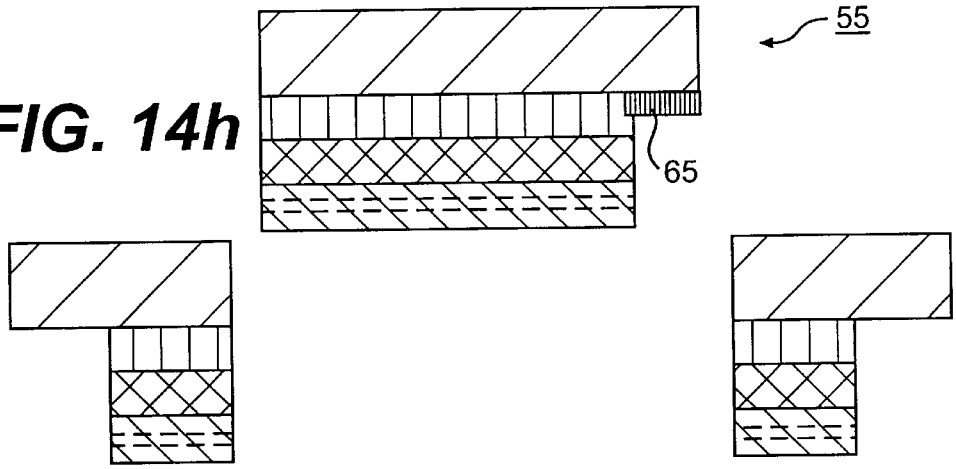
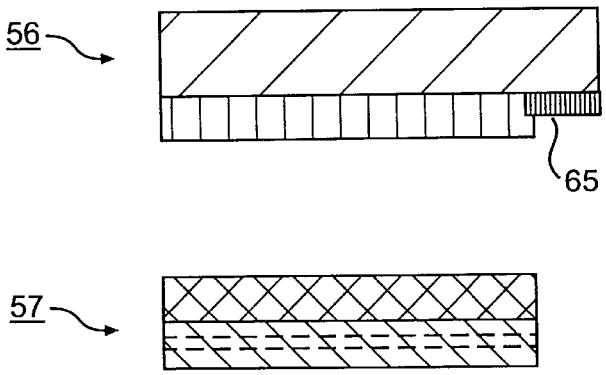
FIG. 14i

FORM WITH INTEGRATED CARD

TECHNICAL FIELD

The present invention relates to a form having an integrated detachable card, it being possible for the form to be of single-layer but in particular multi-layer construction.

The cards may be those which are present in the form in a virtually finished state and only have to be detached. However, there may also be cards which are present in the form not in their final layer construction but in several parts and only have to be finally tailor-made, for example by the user, when being detached, if appropriate by the application of some personalization. Since as a rule a folding operation is associated with this, such cards are also referred to as butterfly cards.

In addition, the cards may be designed such that they initially have the properties of self-adhesive labels or allow self-adhesive labels to be produced from them, for example by pulling off a release paper. The cards may also be designed as so-called vignettes, which are provided to be bonded behind a pane of glass, being provided on their side facing the pane of glass with a specific, if appropriate individual, item of information.

PRIOR ART

Forms with integrated cards of the abovementioned type are known, for example from WO 95/20493 or EP-A1-0 733 490. In the case of the known forms, there is bonded onto the rear side of the primary form material a carrier material which comprises a carrier layer and a peelable glue layer. The card is produced directly in the form in the region of the carrier material by stamping, the stamping being carried out from the front side of the form as far as the carrier layer of the carrier material. The advantage which can be achieved with this design, and which is based on the particular properties of the peelable glue layer, is primarily that the card can be stamped out in a web-free manner and completely around the periphery. The peelable glue is set in such a way that it essentially loses its adhesiveness when the card is detached.

Although suitable peelable glue systems of this type can be implemented in accordance with various principles, these are all associated with a not inconsiderable effort in production and processing. The known peelable glue systems also exhibit a release-value behavior which depends on ambient conditions such as temperature and humidity, and are also therefore industrially not easy to control.

In the case of the previously known forms, on the one hand the overall thickness in the card region is admittedly kept low by including the primary form material in the card, but on the other hand the carrier layer contributes substantially to this overall thickness. From the point of view of processing the forms in printers, in particular using the single-sheet process in laser printers, an overall thickness which is as low as possible in the card area is desired.

DESCRIPTION OF THE INVENTION

The invention, as it is characterized in patent claim 1, achieves the object of specifying a form with an integrated detachable card which manages without peelable glue and without a carrier layer which is not a constituent part of the finished card. According to the invention, this is achieved by a form in which the card is connected to the material surrounding it, at least partly along its external margin in the form (card margin) via a bridge which is designed as an intended rupture line, the material thickness along the bridge being continuously lower than the overall thickness of the form.

Preferred refinements and developments of the invention are specified in the dependent claims.

The bridge is thus advantageously formed, for example, by an inner or an outer part layer, all the other part layers being severed from one or from both sides of the form along the bridge on the card margin, for example by being stamped. In this case, the bridge can also or alternatively be formed by a residual thickness between two cutting lines which are made from both sides of the form, and are mutually congruent or at least essentially mutually congruent.

The designs mentioned allow the desired retaining value of the card in the form to be set well, to be specific purely geometrically via the depth of the cut or of the cuts or the residual thickness resulting therefrom of the part layer which has been left intact, or via the residual thickness between two cuts made from both sides of the form. For example, a residual thickness in the range between 10 $\mu$ and 50 $\mu$, in particular between 15 $\mu$ and 25 $\mu$, has proven to be favorable, the optimum value depending on the type of material and/or being determined by the application.

In particular if the form is stamped from both sides and thus provided with incisions along the card margin and the bridge, the card may be separated from the form simply and without there being the risk that the material will tear otherwise than along the bridge as a predefined intended rupture line.

The bridge can be formed over its longitudinal extent in a uniform and web-free manner, or else in cut and web sections that alternate like a sawtooth or in the manner of a perforation. However, as distinct from a "classical" perforation, in this case the material is at least partially cut even in the web sections, so that only said residual thickness is still present in the region of the webs.

By means of a structured or differentiated design of the bridge in this way, the retaining force of the card in the form may be set more precisely and more finely, and good results with regard to its detachment can also be achieved if the bridge is arranged in an outer layer and the remaining part layers are severed only from the side opposite this layer.

By means of additional film covering layers, applied on one or both sides to, for example, a supporting paper layer, it is possible to produce plasticized cards, as in the prior art. Because of their rather unfavorable tearing or tear propagation properties compared to paper, however, the film layers are less suitable for constructing the bridge. The bridge is therefore advantageously constructed, for example, in the supporting paper layer and the film covering layer(s) is/are completely severed along the bridge on the card margin.

In the case where film covering layers are present on both sides, if it is desired to avoid severing these layers from both sides, it is then necessary for one of these layers or a part layer to be used to form the bridge. By structuring the bridge over its length, as mentioned, in the manner of a perforation with very short webs, however, good results with respect to the detachment of the card can also be achieved here, whilst avoiding undesired tearing.

Using additional release layers or additional release layer material, it is also possible to implement butterfly cards, cards containing self-adhesive labels or vignettes.

Since, by comparison with the previously known, at least the carrier layer and the peelable glue layer are dispensed with, it is possible to write on the cards over the entire area on the front and rear side, even when they are still integrated in the form. If film covering layers are present, these may be specifically treated if necessary for the purpose of writability, that is to say, for example, provided with a matt finish.

The subject matter of the present invention is also a method for producing the forms according to the invention of the type previously described, wherein according to patent claim 24, in order to produce the card, the form is stamped congruently or at least essentially congruently from both sides, at least partly along the card margin.

Stamping on both sides may be carried out on individual forms or on continuous webs, in which the forms are still coherent. It can be carried out from both sides simultaneously in relation to the two sides or else one after another. The requirements which result in this case on the maintenance of register can in principle be coped with.

The concept according to the invention is largely independent of material and thickness. It functions just as well in a simple paper as in a complicated multi-layer construction.

In comparison to cards based on the peelable glue principle, in spite of higher retaining force, the card can be removed from the forms according to the invention without a curl effect, since the card virtually does not have to be bent when being removed, but can simply be pressed through.

Dispensing with carrier material and peelable glue reduces the production costs by comparison with the previously known forms.

Further refinements and advantages of the invention emerge from the following description of exemplary embodiments in conjunction with the appended drawings.

WAYS OF IMPLEMENTING THE INVENTION

Figure 1:
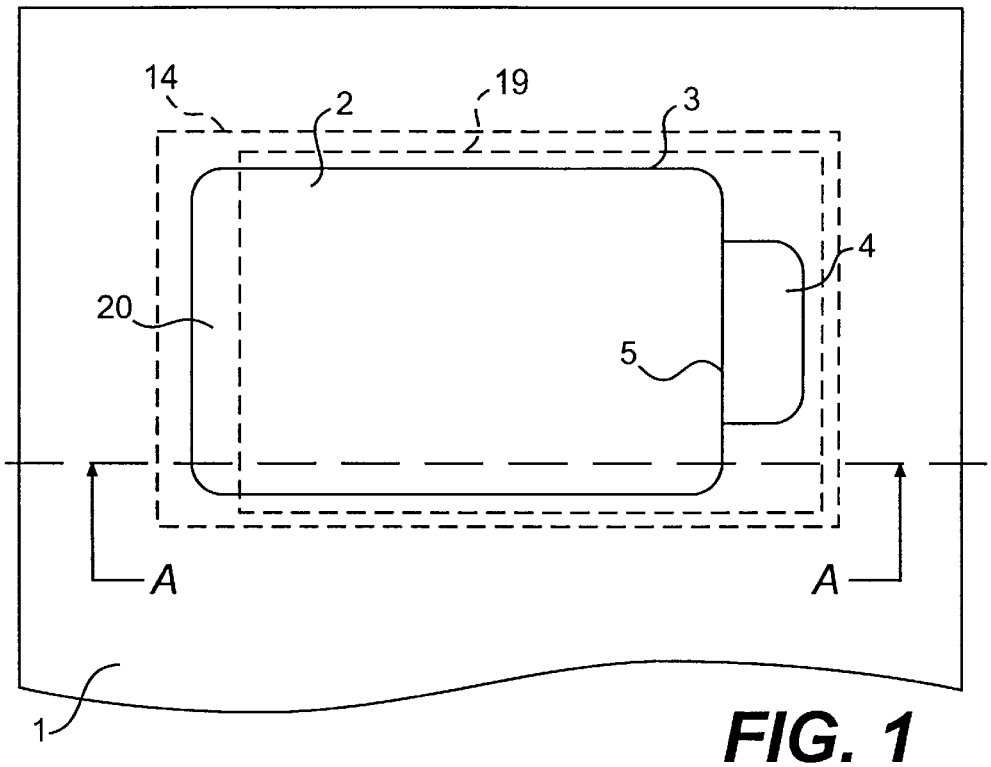
FIG. 1 shows, in plan view, a part of a form according to the invention with an integrated card.

In FIG. 1, 1 designates a form, which is illustrated only partially in plan view on its front side, and 2 a card which is integrated therein. The card margin is designated by 3. A hole 4, through which a section 5 of the card margin 3 is exposed, is stamped out adjacent to the card margin 3. The hole 4 facilitates the removal of the card 2 and therefore forms a type of removal aid.

FIGS. 2 to 6 show examples of possible layer constructions of the form of FIG. 1 in section, the section in each case being made along the line A—A in FIG. 1.

Figure 2A:
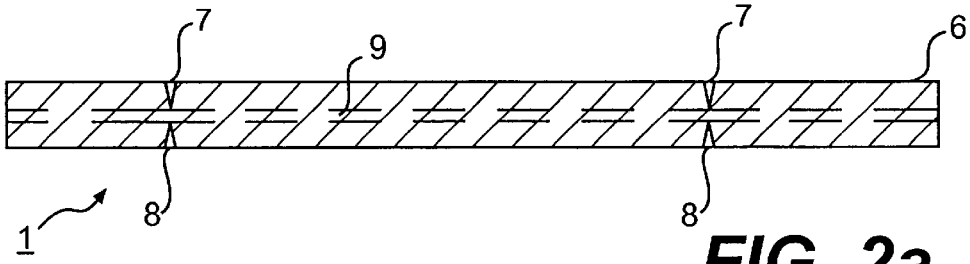
FIG. 2 shows, under a) and b) in section, a form according to FIG. 1 which comprises only one paper layer.
Figure 2B:
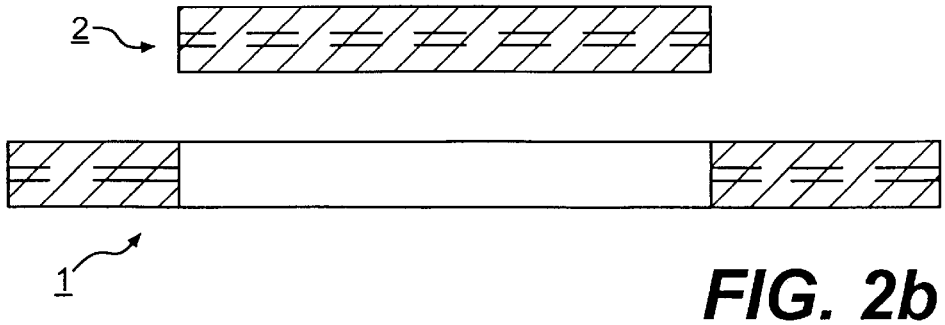

In the example of FIG. 2, the form 1 is of single-layer construction, that is to say it consists only of a paper layer 6. According to FIG. 2*a*), this is stamped along the card margin 3 both from the front side (stamping line 7) of the form and also from the rear side (stamping line 8) of the form as far as the depth of a part layer 9 lying inside. The two stamping lines 7 and 8 are carried out such that they run around the entire periphery, are web-free and congruent. The part layer 9 forms, along the card margin 3 between the two stamping lines 7 and 8, a bridge which is designed as an intended rupture line. By means of pressure on the card surface or by gripping the card margin 5 in the region of the hole 4 stamped out as removal aid, this bridge can be destroyed and the card 2 removed from the form. FIG. 2*b*) shows the form with detached card 2.

Figure 3A:
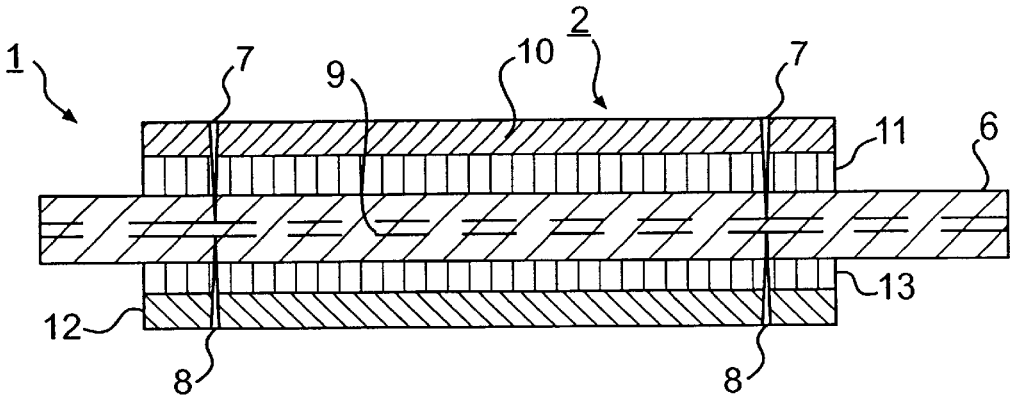
FIG. 3 shows, under a) and b) in section, a form according to FIG. 1 which is provided with film covering layers in addition to a supporting paper layer.
Figure 3B:
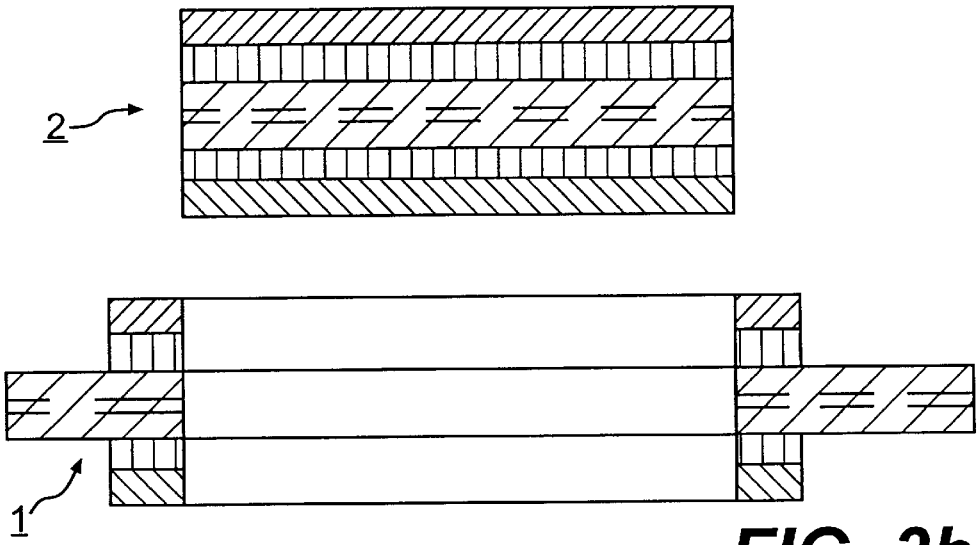

The embodiment of FIG. 3 shows a form of multi-layer construction, but which is based on the same principle as that of FIG. 2, that is to say here as well the card 2 is kept in the plane of the form by an internal part layer 9 of a paper layer 6. Here, however, additional film covering layers 10 and 12 are bonded to the paper layer 6 on the front and rear side by means of adhesive layers 11 and 13. The two stampings 7 and 8 are carried out through these additional layers and thus sever the latter completely along the card margin. By this means, the detachment of the card is significantly facilitated and it is in particular ensured that the bridge formed by the continuous part layer 9 of the paper layer 6 tears in the desired manner only along the card margin. The tearing edge between the two film covering layers always becomes frayed out slightly. Given a suitable design, however, this fraying lies in the microrange, can be detected only with magnification and is virtually not perceptible in a tactile manner. On the other hand, however, the fraying out is advantageous from the point of view of bonding the adhesive exposed at the film edges. FIG. 3*b*) shows the form 1 with the card 2 detached. The detached card virtually cannot be distinguished from a completely cut-out card according to the prior art.

The additional layers 10–13 can be designed to be of smaller area than the paper layer 6. It is sufficient, as is indicated in FIG. 1 by the broken line 14, if said additional layers cover the region of the card 2 and, if appropriate, in addition the region of the removal aid 4. In order to achieve a uniform thickness, however, they could also be laminated over the entire area to the paper layer 6. A uniform thickness has a favorable effect on the stackability of the forms and their processing in single-sheet printers.

Figure 4:
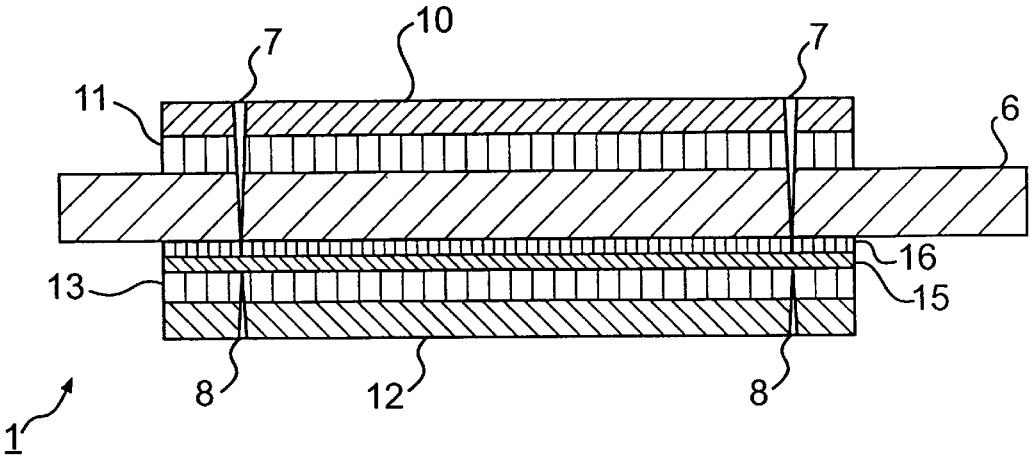
FIG. 4 shows in section a form according to FIG. 4 [sic], in which the bridge along the card margin is formed by a separate part layer.

In the embodiment of FIG. 4, the bridge, via which the card 2 is retained in the form plane, is formed by a separate part layer 15 which is bonded by means of an adhesive layer 16 to the paper layer 6, here to its rear side. The layer 15 is preferably a thin paper layer. The two congruent stampings 7 and 8 are carried out as far as the layer 15. In this embodiment it becomes clear that the location and type of the part layer which has not been stamped through and forms the bridge is variable in the layer construction of the form.

Figure 5:
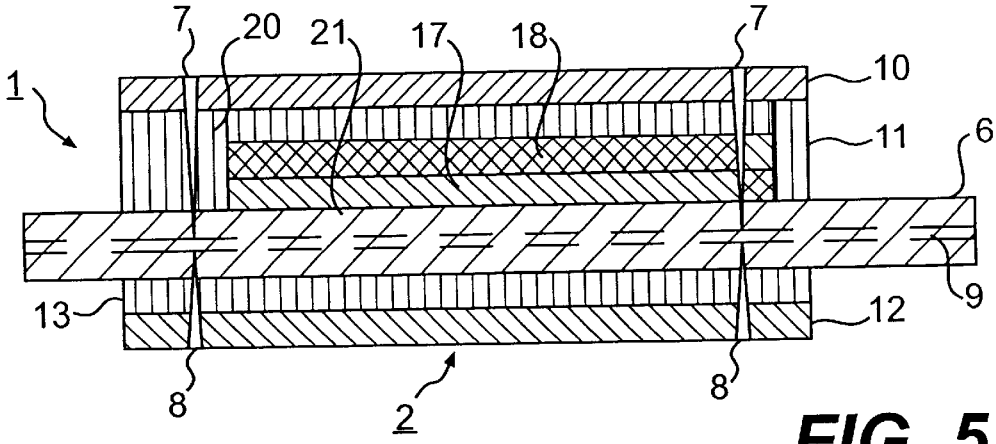
FIG. 5 shows in section a form according to FIG. 4, in which, in order to construct a first type of butterfly card, a release-layer material is provided under the film covering layer on the front side.

FIG. 5 shows an embodiment having a first type of butterfly card. Given an otherwise identical construction as that of FIG. 3, a further piece of a release material with a supporting layer 17 and a release coating 18 is inserted between the front covering layer 10 and the front adhesive layer 11, said release coating 18 facing the adhesive layer 11. Although the adhesive layer 11 has been drawn for illustrative reasons with an unequal thickness, it may actually be of uniformly thick design. The release material piece is somewhat smaller in terms of area than the front covering layer 10 or the adhesive layer 11, and covers only the region which is outlined in FIG. 1 by the interrupted line 19 and which also does not completely cover the region of the card 2. In the zone of the card 2 which is designated by 20, on the one hand the covering layer material 10 is as a result directly bonded to the surface 21 of the paper layer 6; on the other hand the card margin 3 and the stamping line 7 following the latter run outside the release material there. Otherwise, however, the release material is completely severed by the stamping line 7.

On the basis of the design described above, the front film covering layer 10, together with the piece of release material cohering thereto, can be bent up in the region of the card 2, and the surface 21 of the paper layer 6 partly exposed, for example for the purpose of individual inscription. The inscription can subsequently be sealed by bonding the film covering layer 10 to the paper surface 21. For this purpose it is necessary only to remove the piece of release material, and expose the adhesive layer 11.

Figure 6A:
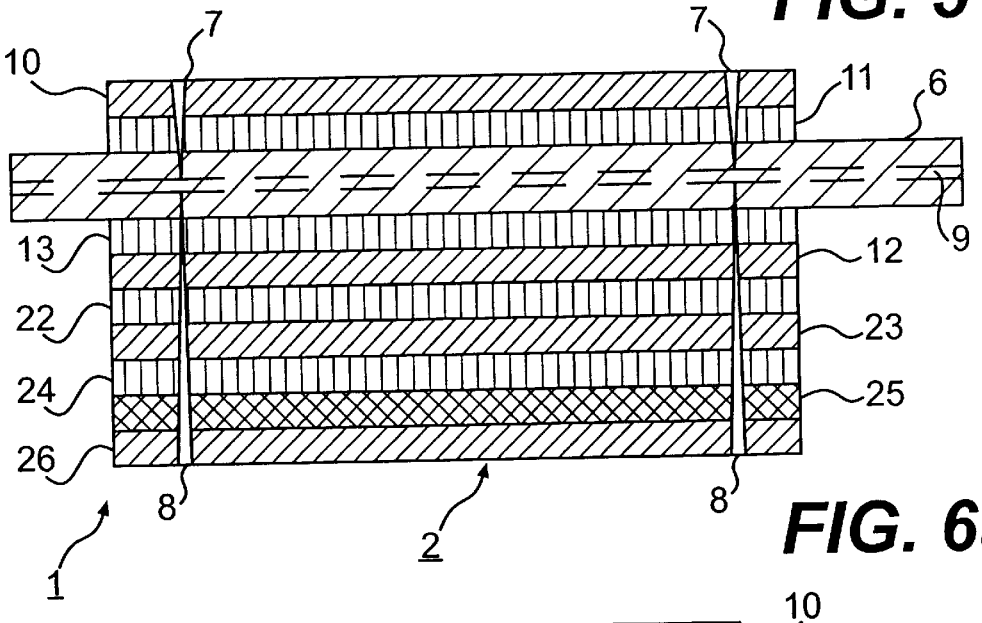
FIG. 6 shows in section, under a) and b), a form according to FIG. 4 in which further part layers are applied on the rear covering layer.

The exemplary embodiment of FIG. 6 is likewise based on that of FIG. 3, only here in addition further part layers 22–26 are provided on the rear side film covering layer 12. The part layer 22 is a peelable glue layer, and the part layer 23 is, for example, a paper layer, which can be provided with a specific imprint. This is followed by an adhesive layer 24 and finally by a release material having a release coating 25 on a supporting layer 26.

Figure 6B:
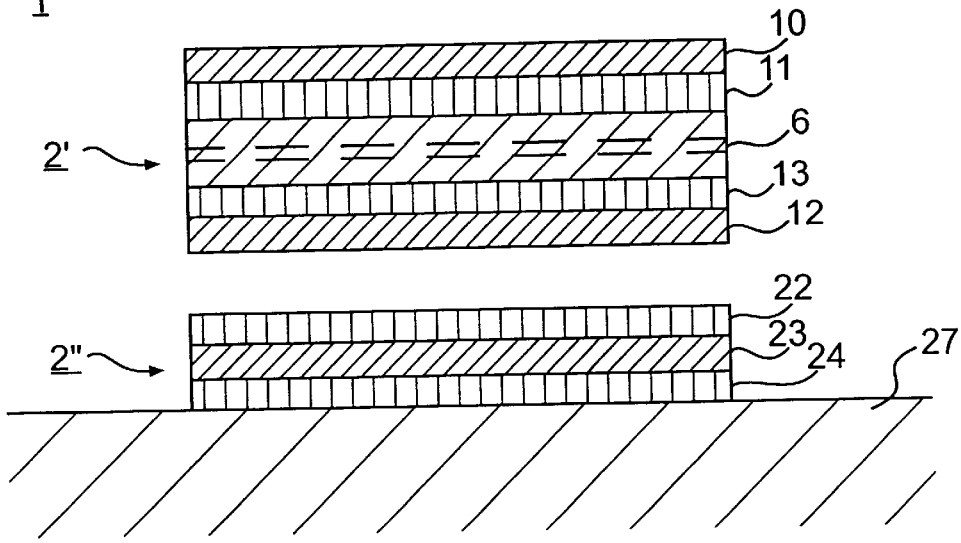

This construction makes it possible to remove the release material 25/26 on the rear side when the card 2 is detached, and to bond the card onto any desired surface 27, like a self-adhesive label, by means of the adhesive layer 25 which is exposed on said card. By releasing the non-permanently set connection between the peelable glue layer 22 and the film covering layer 12, it is subsequently possible still to obtain a free, non-self-adhesive card 2' having a structure corresponding to the example of FIG. 3. In this case, the three layers 22–24 remain on the surface 27. Any inscription which is applied to the layer 23 becomes visible. This is shown by FIG. 6*b*). The remaining part can be used, for example as a control label 2" for the card 2'. The peelable glue layer 22 is preferably set in such a way that, following its separation from the film covering layer 12, it is no longer adhesive.

Figure 7:
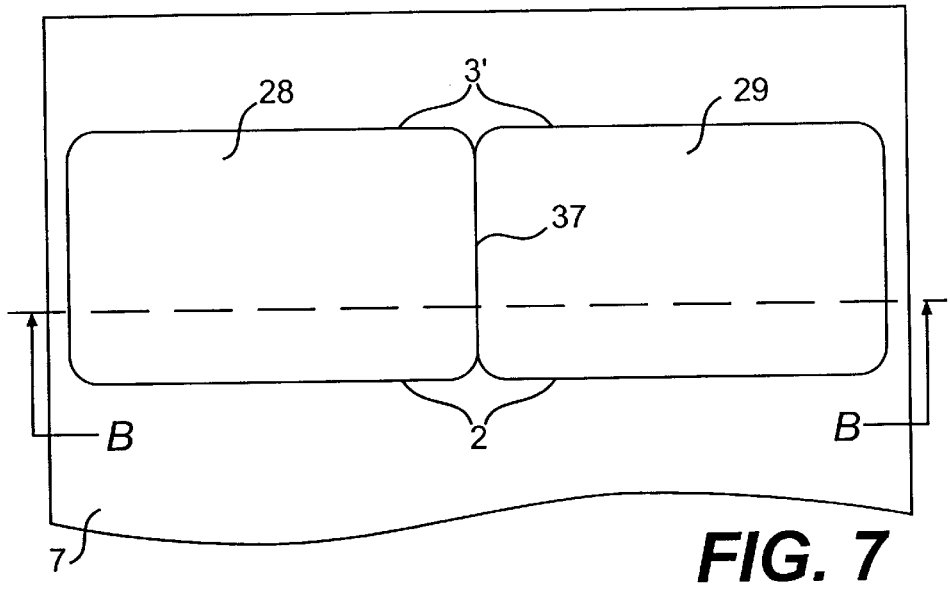
FIG. 7 shows in plan view a part of a form according to the invention with an integrated butterfly card of the second type or vignette.

FIG. 7 shows, like FIG. 1, a plan view of a part of a form 1 according to the invention, but the integrated card here is a butterfly card of the second type or a vignette, which are present in two regions 28 and 29 in the form 1 in the folded-out form.

Figure 8A:
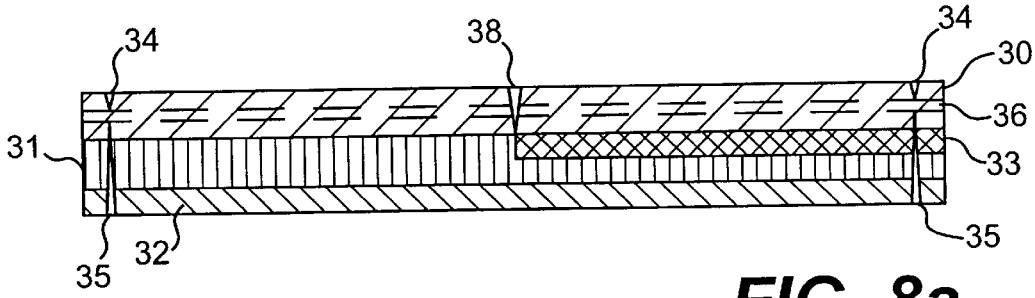
FIG. 8 shows, in section under a) and b), a form according to FIG. 7 in a design having an integrated butterfly card of the second type.
Figure 8B:
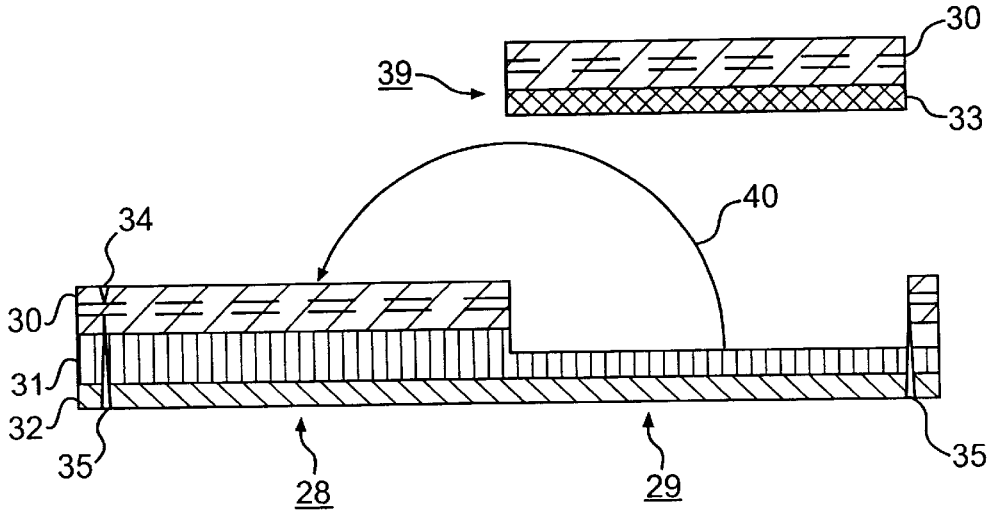

Using FIG. 8, a form according to FIG. 7 is first described in a design with an integrated butterfly card. The form 1 comprises, according to FIG. 8*a*), a paper layer 30, to which a film covering layer 32 is bonded on the rear side by means of an adhesive layer 31. In the region 29, a release layer 33 is further inserted between the paper layer 30 and the adhesive layer 31. Corresponding to the exemplary embodiments previously described, the form 1 is stamped from both sides, the stamping lines 34 and 35 being carried out along the outer margin 3' of the two card parts (card margin in the form) in the regions 28 and 29, as far as into the depth of a part layer 34 of the paper layer 30, in a manner which runs completely around the periphery, is web-free and congruent. The form material is stamped from the front side additionally as far as into the depth of the adhesive layer 31 along the line 37 between the two regions 28 and 29 (stamping line 38).

In the case of the construction of FIG. 8, in a first step an auxiliary card 39, which can be used for example as a coupon or control card, can be detached from the region 29 of the form 1, the bridge formed by the part layer 36 of the paper layer 30 being destroyed along the stamping lines 34 and 35 in this region. As a result, the two layers 31 and 32 which lie underneath the latter also lose their connection to the material surrounding them in this region 29. As a result, these layers can be folded over in a next step in the region 28 and bonded there to the surface of the paper layer 30, as is indicated by the arrow 40. This results in a card which is provided on both sides with film covering layers, corresponding to that of FIG. 3, which can finally be detached from the form by destroying the bridge formed by the part layer 36 of the paper layer 30 along the stamping lines 34 and 35 in the region 28.

The embodiment of FIG. 8 has the advantage that the surface of the paper layer 30 is exposed in the region 28 and can be inscribed or printed individually before the detachment of the card. In the finished card, on the other hand, this surface is sealed by the film covering layer 32 originating from the other region 29.

Instead of only one release layer 33, in the embodiment of FIG. 8 it is also possible for a release layer material of multi-layer construction and of identical function to be used. In the region 29, the stamping 34 could also be left out, the auxiliary card 39 then being dispensed with. In addition, it would be necessary for the actual card to be detached downward from the form in the folded-out state, and to be finally customized by folding and bonding its two parts onto one another only in the detached state.

Figure 9A:
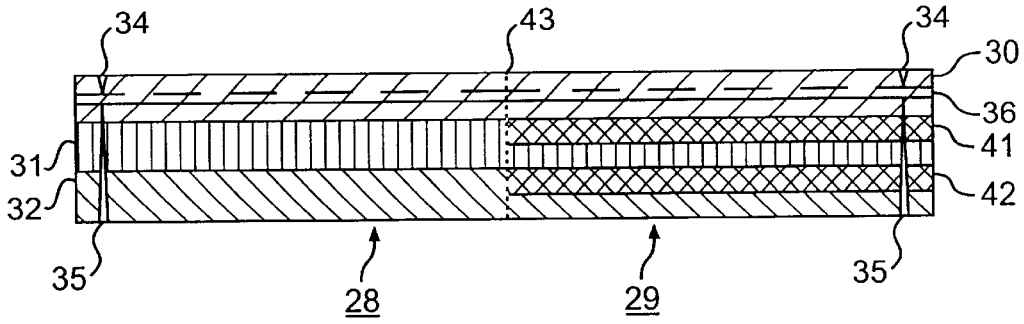
FIG. 9 shows, in section under a) to e), a form according to FIG. 7 in a design with an integrated vignette.
Figure 9B:
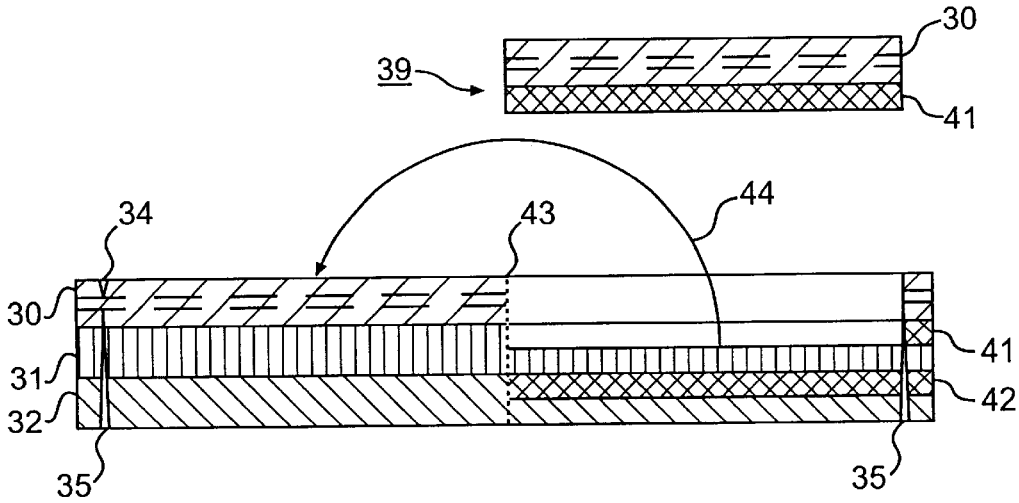

FIG. 9 shows a form according to FIG. 7 in a design with an integrated vignette, the layer construction being visible from FIG. 9*a*). Said construction largely corresponds to that of FIG. 8*a*), only instead of one release layer 33, two release layers 41 and 42 are provided on either side of the adhesive layer 31 lying in between. In addition, the form material is provided, along the line 37 between the two regions 28 and 29, with a perforation 43, which is stamped through all the part layers.

Figure 9C:
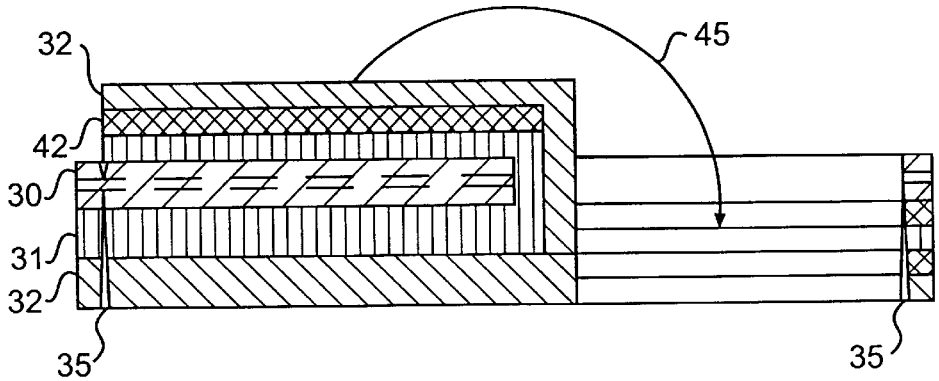
Figure 9D:
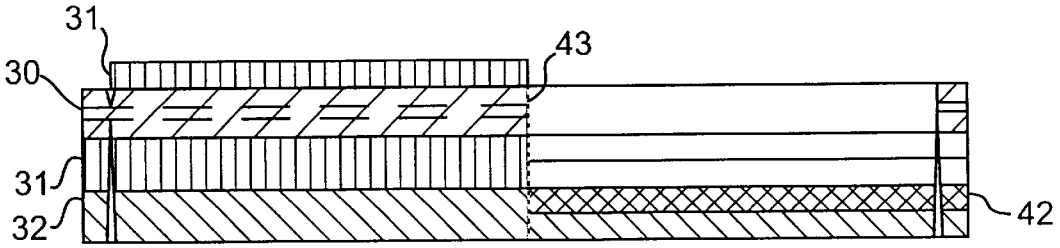
Figure 9E:
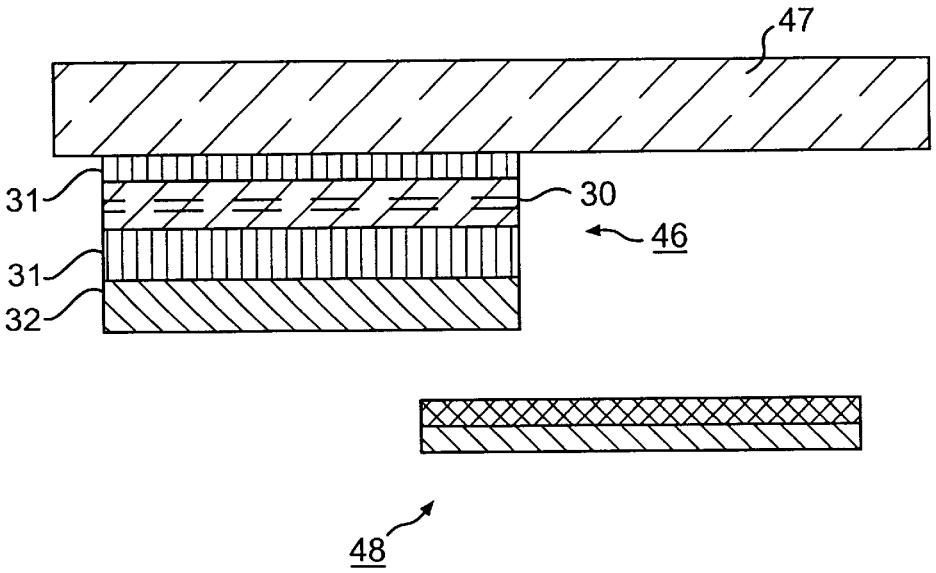
Figures 10A, 10B, 10C:
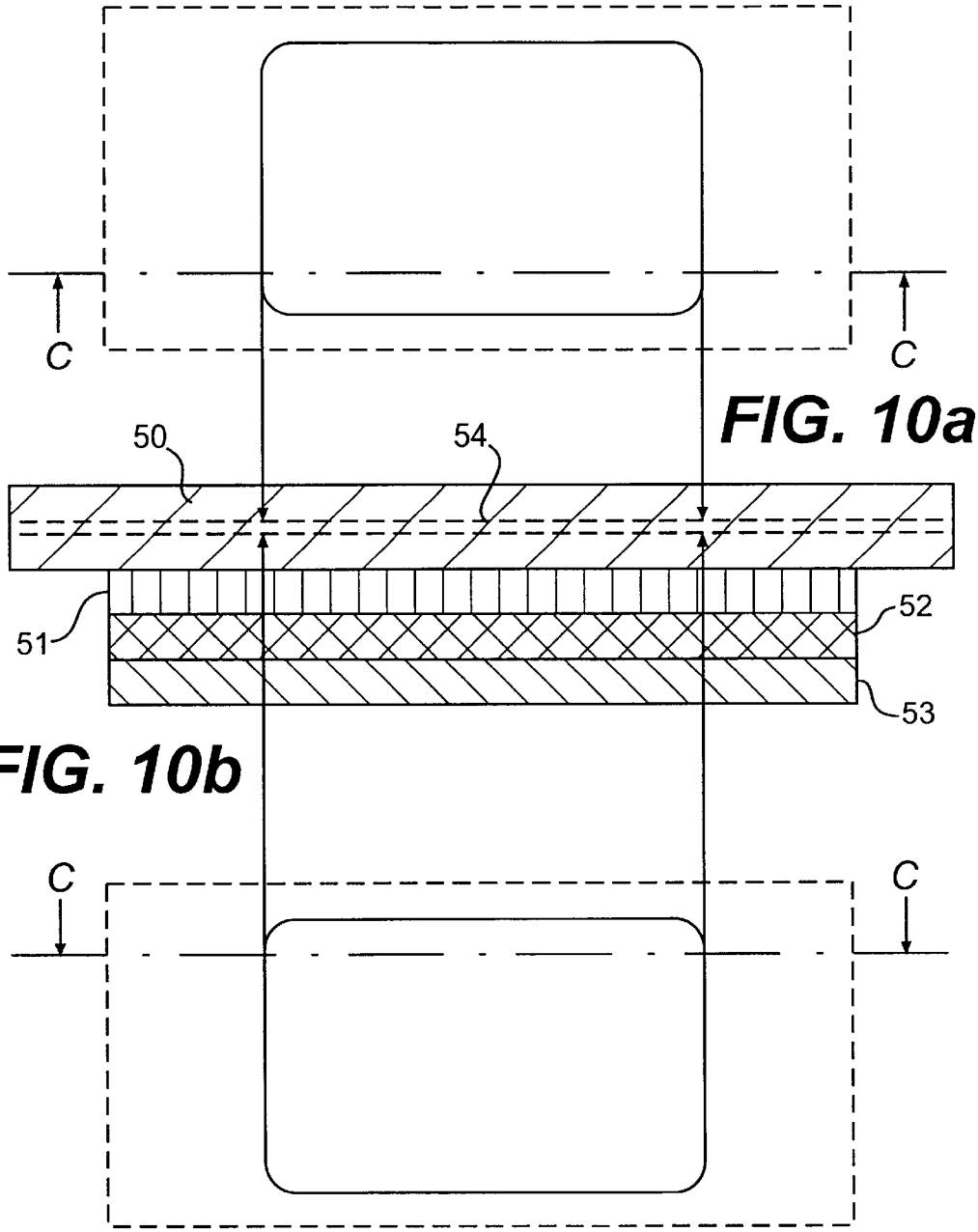
FIG. 10 shows, partly in plan view of the front and the rear side, and partly in section under a) to f), a form having a card which comprises a self-adhesive label covered by a release paper.
Figure 10D:
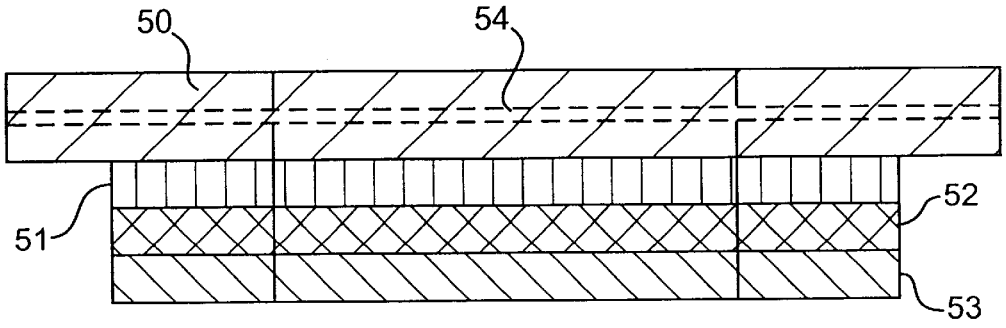
Figure 10E:
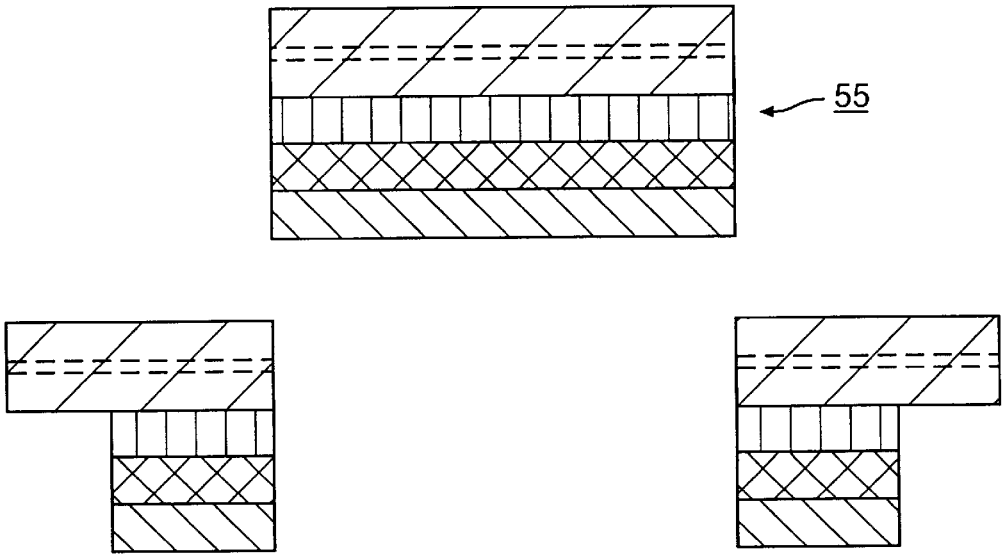
Figure 10F:
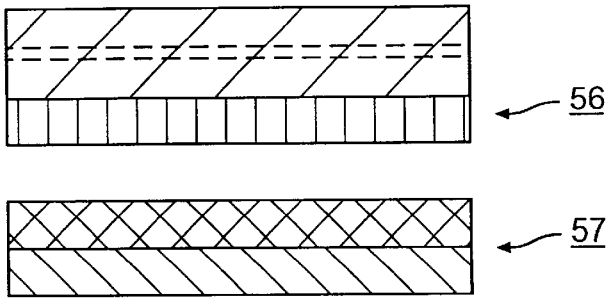

The development to produce and to detach the vignette is as follows: firstly, once more an auxiliary card 39, which can be used for example as a coupon or control card, is detached from the region 29 of the form 1, the bridge formed by the part layer 36 of the paper layer 30 being destroyed along the stamping lines 34 and 35 in this region. As a result, the layers 31, 32 and 42 which lie below the latter also lose their connection to the material surrounding them and, in a second step, can be folded over into the region 28 and bonded there to the surface of the paper layer 30, as is indicated by the arrow 44 in FIG. 9*b*). The resulting structure is shown by FIG. 9*c*). Proceeding from this structure, as a third step a further folding operation is necessary in which, according to arrow 45 in FIG. 9*c*), however, only the two uppermost layers 32 and 42 are folded back once more out of the region 28 into the region 29. The adhesive layer 31 in this case remains on the surface of the paper layer 30 in the region 28. The result of the second folding operation is shown by FIG. 9*d*. Taken together, the two folding operations (arrows 44 and 45) lead to a transfer of the adhesive layer 31 from the region 29 into the region 28. In the region 28, the desired vignette is now already present and can be detached from the form by destroying the bridge formed by the part layer 36 of the paper layer 30 along the stamping lines 34 and 35 in the region 28. Before said vignette is stuck, by means of the adhesive layer 31 exposed on its surface, behind a pane 47 according to FIG. 9*e*), the piece of covering film 48, which is still cohering to it via the perforation 43 and has previously been folded to and fro, is finally separated. An inscription applied to the surface of the paper layer 30 in the original form, in the region 28, can be seen through the pane 47.

In the exemplary embodiments according to FIGS. 8 and 9, the part layers in each case bonded to the rear side of the paper layer 30 are equally large in terms of area as the paper layer itself, as a result of which the form as a whole obtains a uniform thickness. However, if appropriate to save material, the said part layers can be selected to be smaller in terms of area than the paper layer.

The exemplary embodiments explained below using FIGS. 10–16 relate to all forms having cards which comprise a self-adhesive label, as was already the case per se in the case of the embodiment of FIG. 6. The embodiment of FIG. 10 can consequently also be derived from that of FIG. 6 by leaving out various layers.

In the example of FIG. 10, a release paper having a release layer 52 and a supporting layer 53 is bonded onto the rear side of a paper layer 50 only by means of an adhesive layer 51. The form is stamped congruently from both sides as far as into the depth of a part layer 54 in the paper layer 50, as is shown by FIGS. 10*a*)–*c*). FIG. 10*d*) corresponds to FIG. 10*b*). FIG. 10*e*) shows the form with detached card 55. In FIG. 10*f*), said card has been separated into a simple self-adhesive label 56 and a release paper part 57.

In FIG. 11, the example of FIG. 10 is supplemented on the one hand by a removal aid 58 for the card 55 and on the other hand by a pulling-off aid 59 for the release paper 57. In order to indicate the design or manufacture of these aids, FIGS. 11*a*) and 11*d*) in each case illustrate plan views of the front side of the form, and FIGS. 11*c*) and 11*f*) in each case illustrate plan views of the rear side of the form. Between the front plan view and the rear plan view, sectional views C—C and D—D are illustrated in FIGS. 11*b*) and 11*e*), using which the stamping depth of the stamping lines drawn in the plan views can be seen in each case.

Figure 11A:
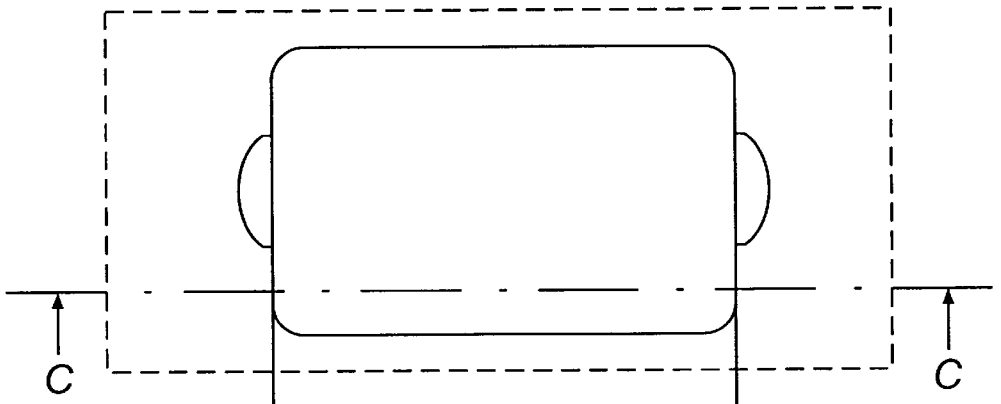
FIG. 11 shows, under a) to i), an embodiment corresponding to FIG. 10, supplemented by a removal aid for the card and a pulling-off aid for the release paper.
Figure 11B:
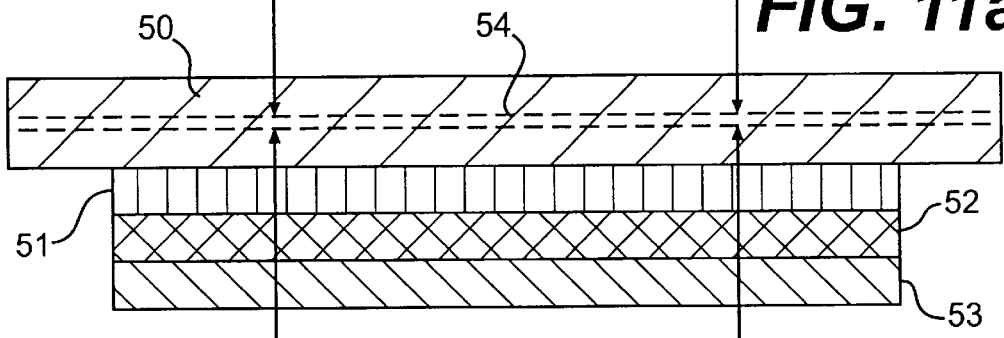
Figure 11C:
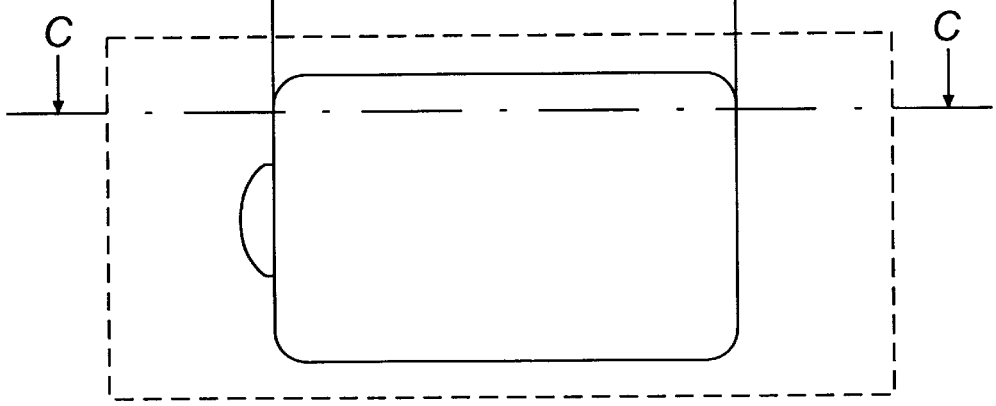
Figure 11G:
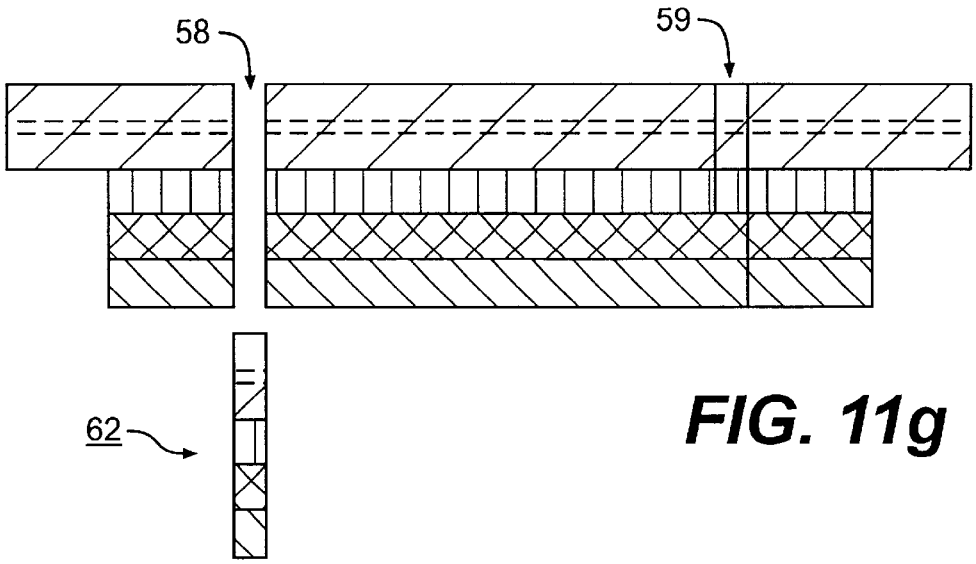
Figure 11H:
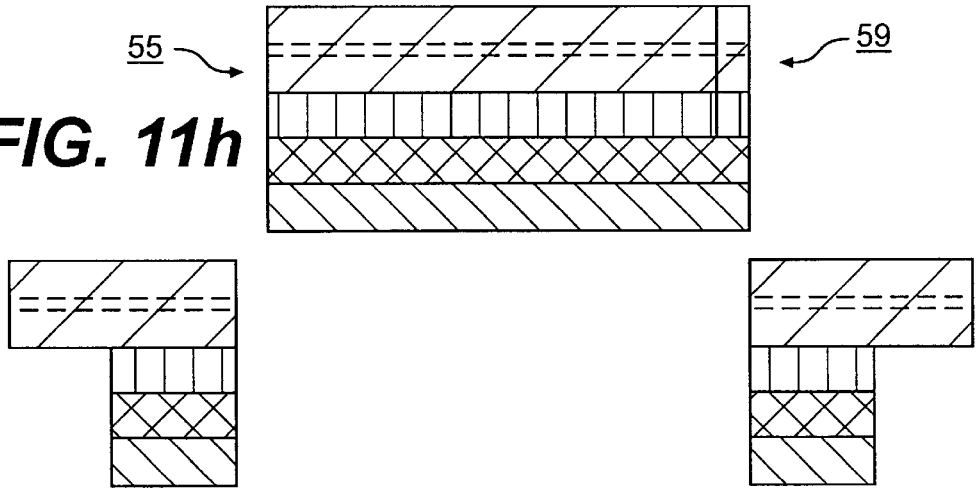
Figure 11I:
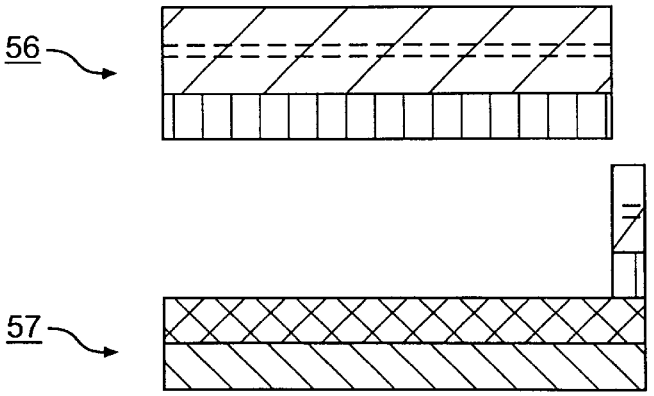

Thus, the form of FIG. 11 is stamped from both sides congruently as far as into the depth of the part layer 54 in the paper layer 50, outside the aids, designated by 58 and 59, according to FIGS. 11*a*)–*c*). This applies correspondingly to the removal aid 58. In the region of the pulling-off aid 59, the form has by contrast not been stamped at all from the rear side. From the front, the form has been stamped in this region along the section 60 on the card margin as far as into the depth of the release layer 52, and fully stamped through along the outer line 61 framing the region of the pulling-off aid 59. As a result of these stampings, differentiated with respect to their depth, as shown by FIG. 11*g*), firstly a stamped portion 62 can be removed from the region of the removal aid 58 as a result of which a hole is produced in the form and a section 63 (FIG. 11*a*) of the card margin is exposed. By gripping the card 55 at this section 63, said card can simply be detached from the form. The detached card 55 is shown in FIG. 11*h*). The pulling-off aid 59 forms on the detached card a type of finger tab, which can be gripped easily and used for separating the release paper part 57 from the self-adhesive label 56, as can be seen using FIG. 11*i*).

Figure 12A:
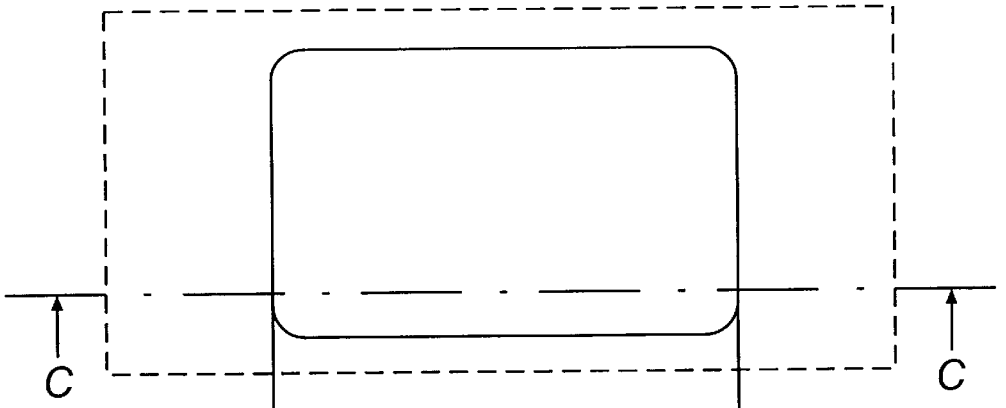
FIG. 12 shows, under a) to c), an embodiment corresponding to FIG. 10, but in which the bridge is formed by a part layer in the release paper.
Figure 12B:
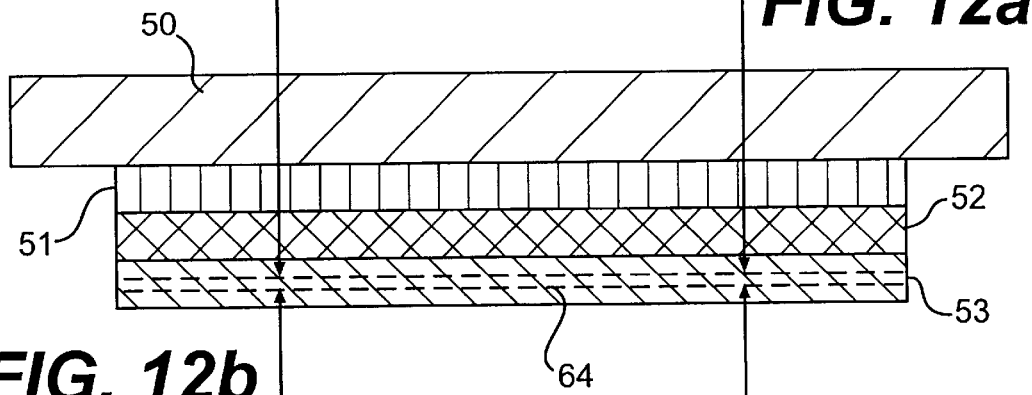
Figure 12C:
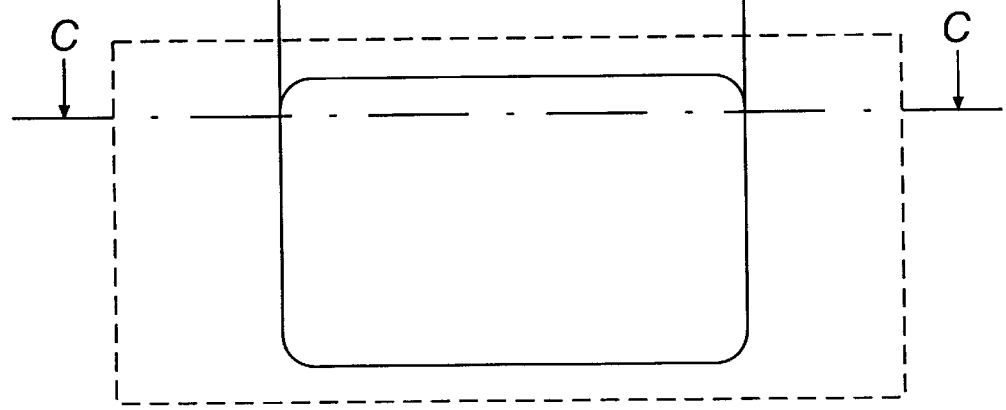

In the embodiment of FIG. 12, the continuous part layer 64 forming the bridge is a part layer of the supporting layer 53 of the release paper 52/53. Otherwise, it corresponds to the embodiment of FIG. 10.

Figure 13A:
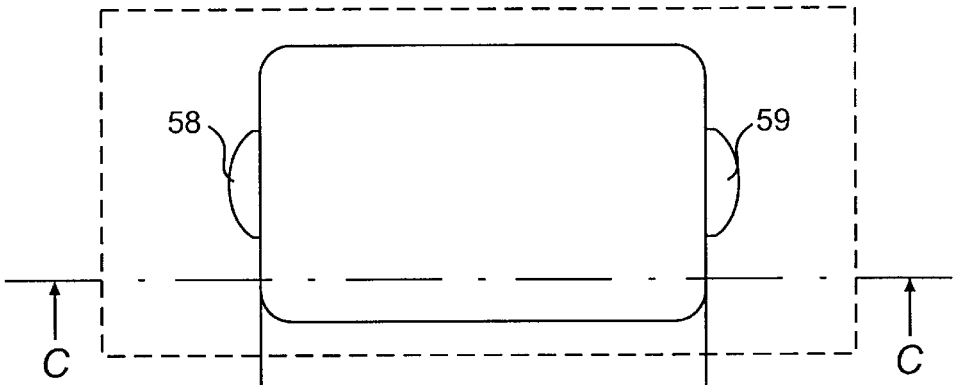
FIG. 13 shows, under a) to i), an embodiment corresponding to FIG. 12, supplemented by a removal aid for the card and by a pulling-off aid for the release paper.
Figure 13B:
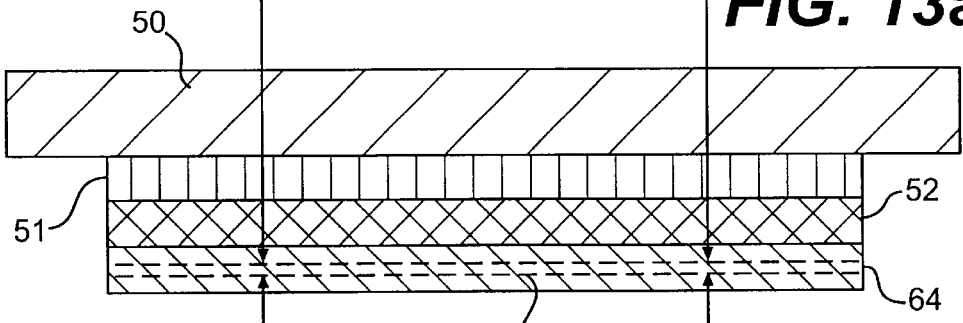
Figure 13C:
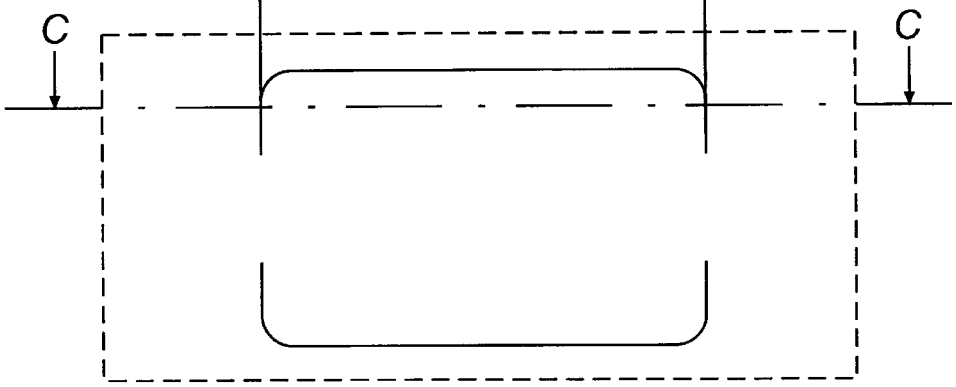

The example of FIG. 13 combines the concepts of the embodiments of FIGS. 11 and 12, that is to say that here the continuous part layer 64 forming the bridge in the supporting layer 53 of the release paper and, in addition, a removal aid 58 and a pulling-off aid 59 are provided. Differing from the example of FIG. 11, the form has been completely stamped through in the region of the removal aid 58, however, so that the stamped portion 62 already loses its connection to the material surrounding it during the production of the form and falls out of the form. In the example of FIG. 11, this could of course be carried out in the same manner.

Figures 14A, 14B, 14C:
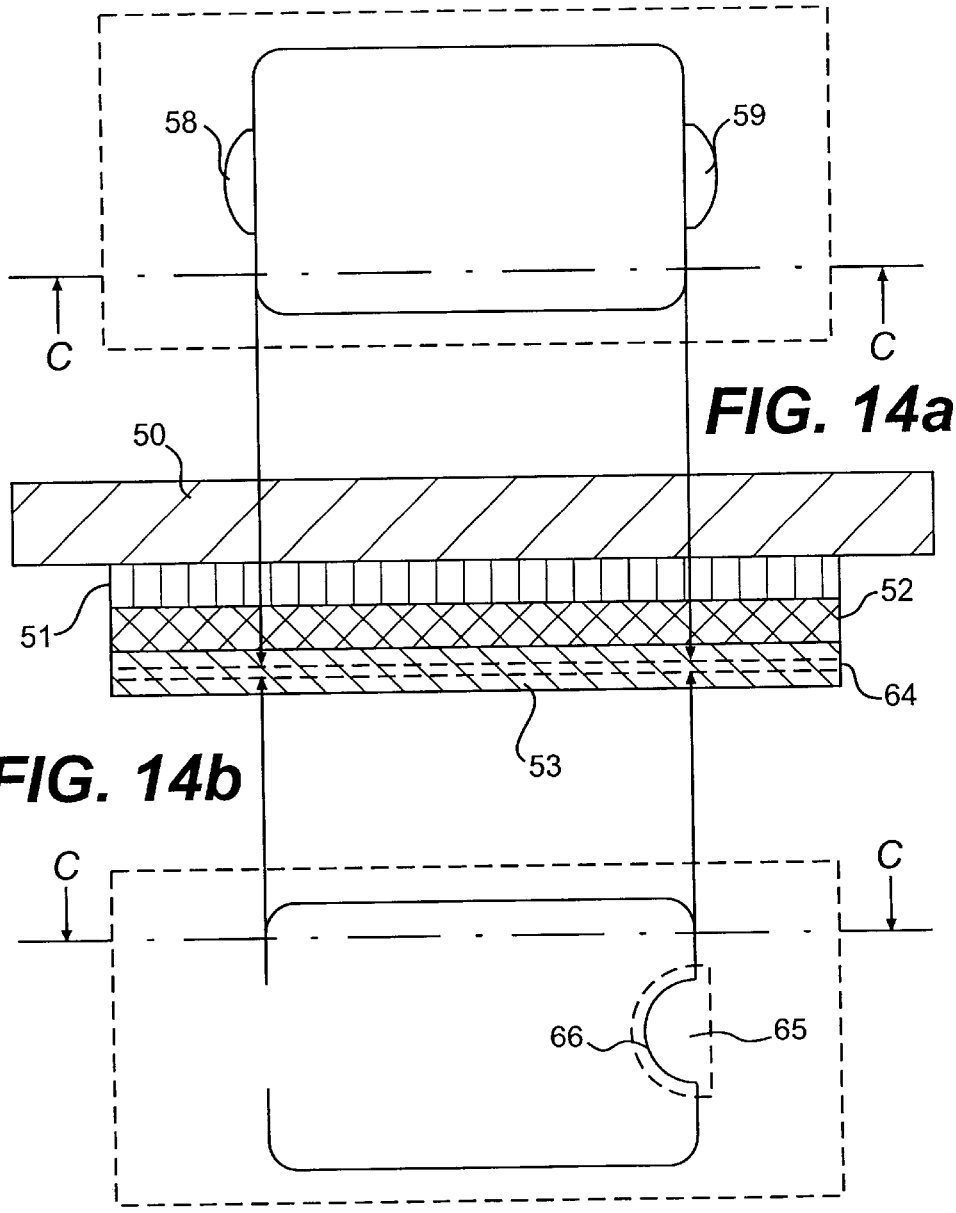
FIG. 14 shows, under a) to j), an embodiment corresponding approximately to FIG. 13, but in which the pulling-off aid is designed such that the self-adhesive label contained in the card can if required also be detached separately from the form, that is to say without the entire card.
Figure 14J:
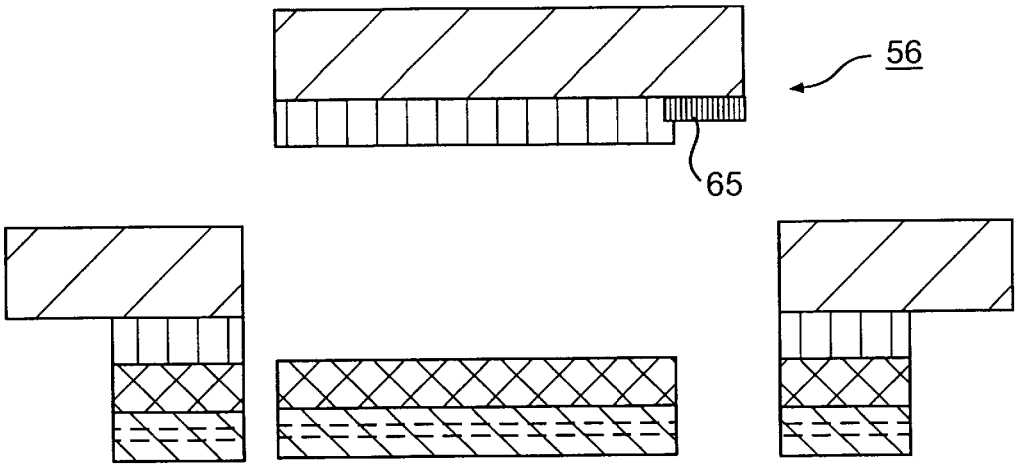

The embodiment of FIG. 14 differs from that according to FIG. 13 only with regards to the design of the pulling-off aid 59. In the region of this pulling-off aid, and projecting beyond the latter somewhat in terms of area, a release coating 65 has been applied locally on the rear side of the form before the application of the adhesive layer 51 and of the release paper 52/53. The local release coating 65 can be seen, inter alia, in FIG. 14*c*). Then, in addition to the stampings from the front, which are carried out according to FIG. 13, a stamping is carried out from the rear side of the form along a line 66 as far as the paper layer 50, as can be seen in FIG. 14*e*). The stamping line 66 runs completely in the region of the card. As a result of this stamping technique, as well as a result of the release properties of the local release coating 65, a stamped portion 67 can be removed in the region of the pulling-off aid 59 and, as a result, an approximately half-moon-shaped gripping zone 68 can be exposed on the rear side of the card between the card margin and the stamping line 66, as is shown by FIG. 14*g*).

With respect to the removal of the card 55 or of the self-adhesive label 56, two options now arise from the gripping zone 68: the option illustrated in FIG. 14 under h) and i) essentially corresponds to that of FIGS. 11–13, that is to say in this case the card 55 is removed completely from the form in a first step, using the removal aid 58, and only subsequently in a second step is the label 56 separated from the piece of release paper 57. By means of pressure from the rear onto the gripping zone 68 mentioned, the self-adhesive label 56 can also be removed from the form separately, that is to say without the piece of release paper 57, the latter remaining in the form. This is illustrated in FIG. 14 under j). A later additional removal of the piece of release paper 57 is of course likewise still possible.

Figure 15A:
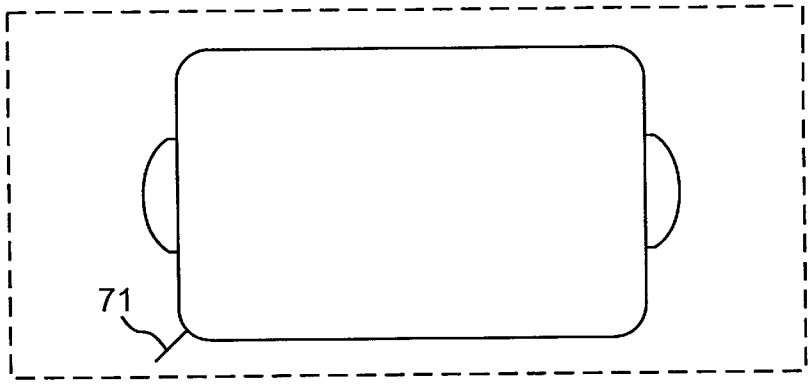
FIG. 15 shows, under a) and b), an embodiment in which the self-adhesive label may likewise be detached separately from the form, but on the basis of other means.
Figure 15B:
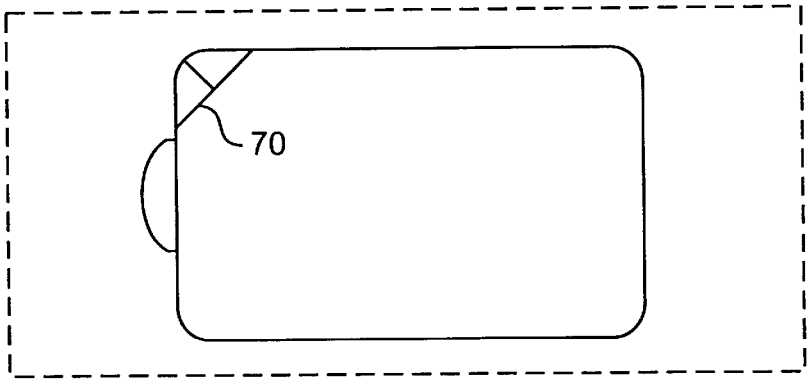

It would also be possible to achieve separate removability of the self-adhesive label 56, proceeding from the embodiment of FIG. 13, in that, as is shown in FIG. 15 only under a) and b), in one corner of the card, from the rear side of the form, a T-shaped stamping 70 is made in the release paper 52/53, and from the front side of the form a short incision 71, adjoining the foot of the T, is made, carried out through all the layers. In the case of this configuration, in order to detach the self-adhesive label separately, pressure with a finger on the corner of the card provided with the T-shaped incision is sufficient.

Figure 16A:
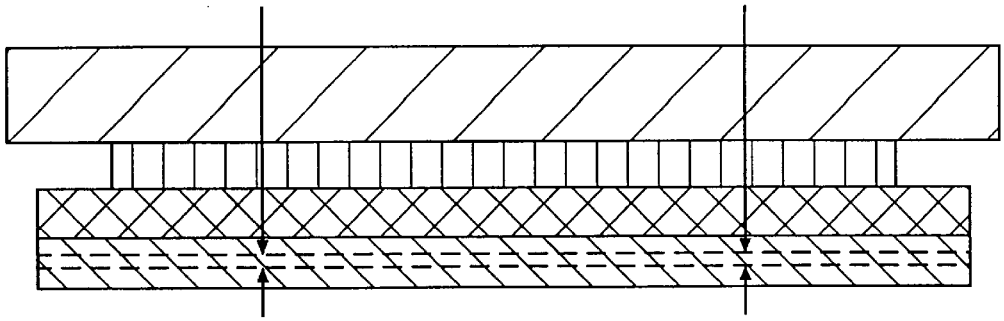
FIG. 16 shows, under a) to c), in each case in section, three further embodiment variants of forms according to the invention having cards comprising self-adhesive labels.

FIG. 16 shows, under a)–c), three variants which can likewise be used within the context of the exemplary embodiments described above:

a) firstly illustrates that the release paper 52/53 can also project somewhat on all sides in terms of area beyond the adhesive layer 51. This makes it possible to counteract effectively the emergence of adhesive of the adhesive layer 51 beyond the margin of the release paper 52/53, and the risk, caused by this, of sticking of several stacked forms. However, only specific types of adhesives show any tendency at all to flow out in this way.

Figure 16B:
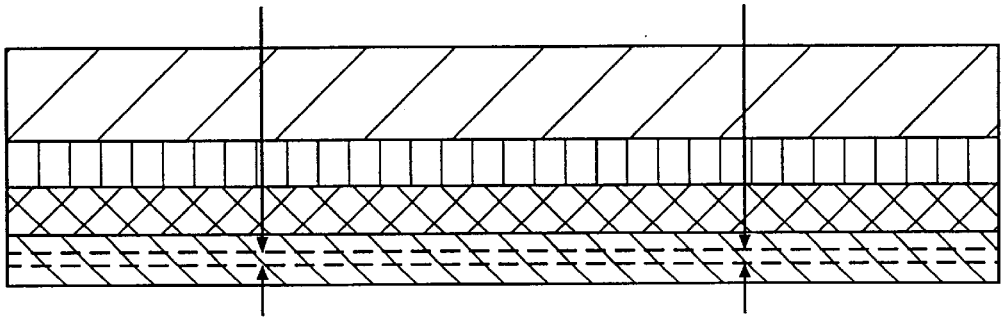

In FIG. 16*b*) the paper layer is laminated over the entire area to the adhesive layer 51 and the release paper 52/53, an option which has already been agreed [sic]. Although in this case more coating material is needed, this results in the advantage of a uniform thickness over the entire region of the form.

Figure 16C:
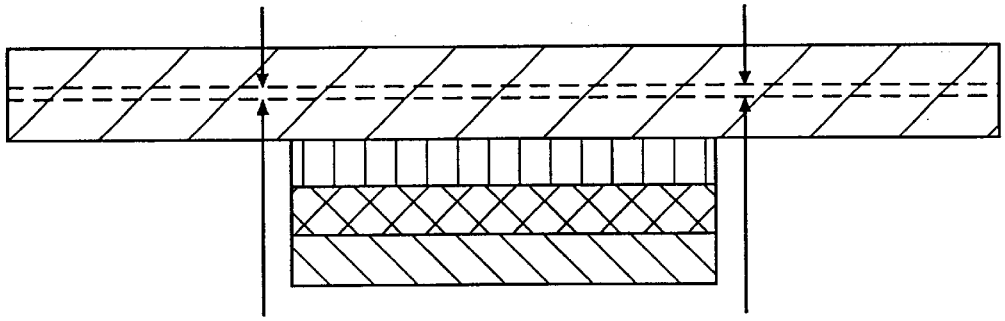

FIG. 16*c*) shows an embodiment in which the stampings to produce the card 55 are carried out outside the region of the adhesive 51 and the release paper coating 52/53.

In the examples according to FIGS. 17 *a*)–*c*), in which for reasons of a simple illustration only one paper layer 80 is provided, the two-sided stamping 81 on one side and 82 on the other side in order to produce the card 83 are not carried out exactly, but only essentially congruently, that is to say they are laterally offset somewhat in relation to one another. The stamping 81 is made down to a depth T1, and the stamping 82 is made down to a depth T2. The thickness of the paper layer is designated by d.

Figure 17A:
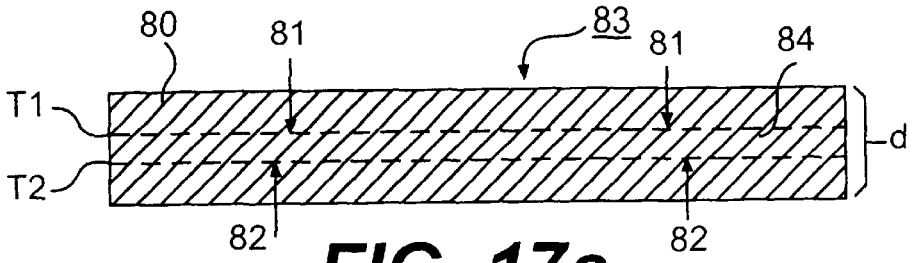
FIG. 17 shows, under a) to c), in each case in section, embodiments in which the bridge or a residual thickness is produced by stampings from both sides, which stampings are laterally offset somewhat in relation to one another.

In the example of FIG. 17*a*), T1+T2<d, so that here, as in the above-described exemplary embodiments, a part layer 84 that is located on the inside remains not stamped through and forms the desired retaining bridge.

Figure 17B:
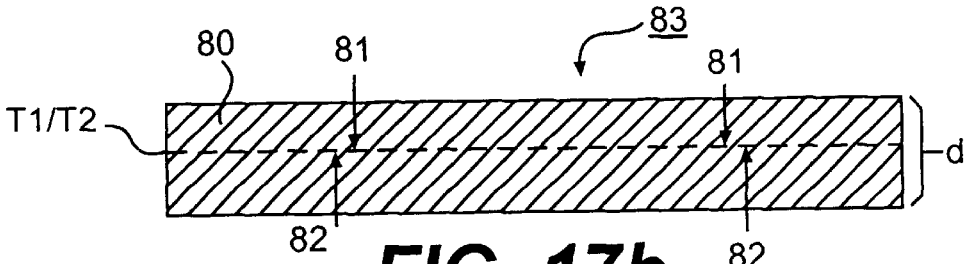

In the example of FIG. 17*b*), T1+T2=d, so that the two stampings reach down to the same depth in the paper layer 80. A continuous part layer that is not stamped through is no longer present here. Nevertheless, as a result of the lateral offset of the two stamping lines 81 and 82 there is still a residual thickness that forms a bridge and retains the card 83 in the form, although this residual bridge is located horizontally in the form instead of vertically or essentially vertically as in the previous examples.

Figure 17C:
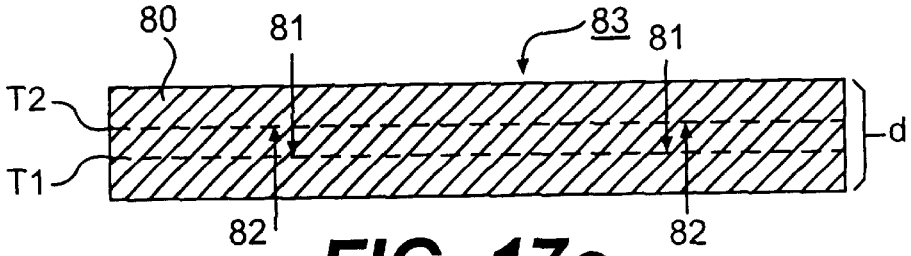

In FIG. 17*c*) T1+T2>d, so that the two stampings 81 and 82 even mutually overcut each other. However, even here there is still a residual thickness between the two stampings.

Of course, the effective residual thickness also still depends on the mutual lateral offset of the two stampings 81 and 82, which in addition to the stamping depths forms an additional, independent parameter, via which the residual thickness can be controlled and adjusted in accordance with the respective requirements.

Figure 18:
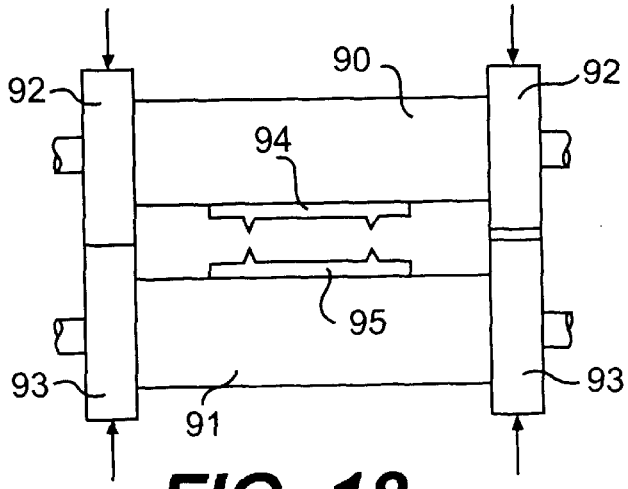
FIG. 18 shows, schematically, a stamping devices [sic] for producing forms according to the invention.

FIG. 18 shows, schematically, a device with which the congruent or essentially congruent stamping on both sides is possible in order to produce forms of the type according to the invention in one operation. 90 and 91 designate two magnetic cylinders which have at their ends in each case rollers 92 and 93 of relatively large diameter which run on one another. 94 and 95 designate thin, metallic stamping sheets, which are placed onto the surface of the two magnetic cylinders 90 and 91 and stick to the latter magnetically. The stamping sheets 94 and 95 are provided in a known way with elevated, sharp cutting webs 86 and, with respect to these webs, are at least partially of mirror-image design. The two stamping sheets can therefore be positioned on the magnetic cylinders 90 and 91 in such a way that corresponding webs lie exactly or at least essentially opposite one another. The diameters of the magnetic cylinders 90, 91, of the rollers 92, 92 [sic], the thickness of the stamping sheets 94, 95 and the height of the cutting webs is selected such that a residual thickness 6 of approximately the magnitude of the thickness of a part layer serving as bridge remains, for example, between cutting webs which lie directly opposite one another.

Figure 19A:
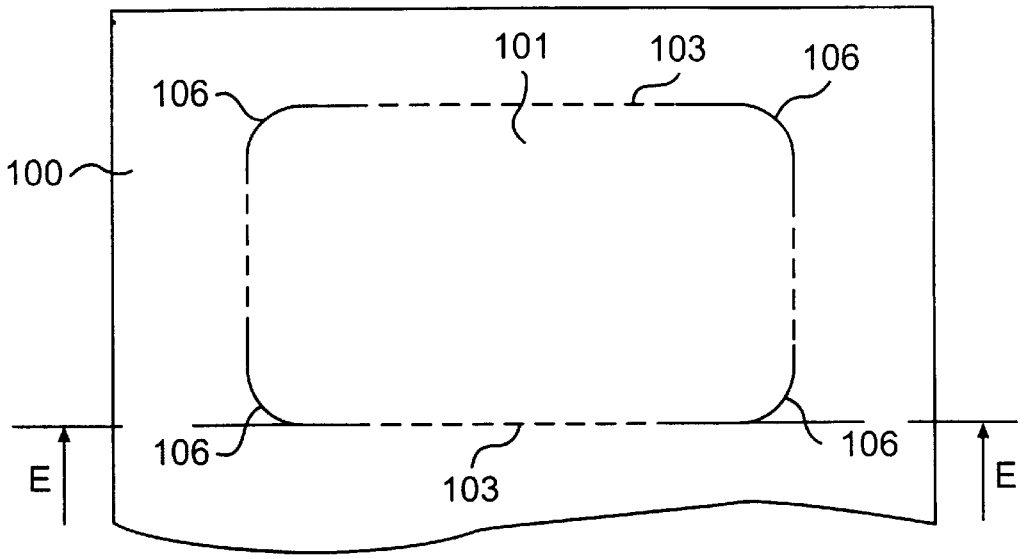
FIG. 19 shows, under a) and b), an embodiment in which the part layer forming the bridge is an outer layer and is intrinsically structured in the manner of a perforation.
Figure 19B:
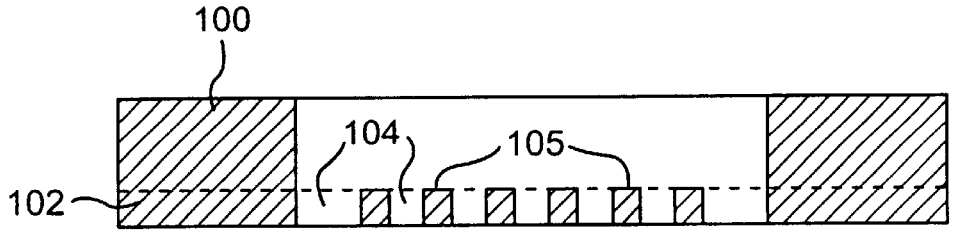

FIG. 19 shows an embodiment which once more has only one paper layer 100. As distinct from the above-described examples, the bridge holding the card 101 is formed here in an outer part layer 102 of the paper layer, to be specific by a single stamping 103 made from only one side of the paper layer. The stamping 103 is also made in such a way that the bridge that results in the outer part layer 102 is interrupted in the manner of a perforation, as is shown by FIG. 19*b*), in which a section E—E along the stamping line 103 is illustrated. The region severed by the stamping 103 is illustrated without hatching in FIG. 19*b*). Along the stamping line 103, completely cut-through sections 104 alternate with webs 105, which on their own still befit the retaining function. The height of the webs 105 corresponds precisely to the thickness or residual thickness of the part layer 102, which is about 50 $\mu$, for example.

Although in FIG. 19*b*) the fully cut-through sections 104 and the webs 105 are illustrated as having a coincident length, they are preferably made differently, to be precise the cut-through sections 104 are made several times longer than the webs 105. The latter are selected to be as short as possible for the respective material, in order that when the card 101 is detached the tear strictly follows the predefined line, and tearing in a manner deviating from this line is avoided. According to available experience, webs 105 of about 0.1–0.3 mm length alternating with fully stamped-through sections 104 of about 0.5–1.0 mm length are already sufficient still to hold the card 101 firmly in the form 100 (the card 101 is held sufficiently firmly in the form, for example, when the latter can be deflected under tension around a deflection roll of 22 mm diameter without the card 101 becoming detached in the process). On the detached card 101, webs which are so narrow and also low, because of the residual thickness that is still present, are hardly possible to make out optically or by touch, and therefore also do not have a very disturbing effect, as distinct from the "classic" perforation webs, whose height always corresponds to the complete material thickness. The great advantage of the embodiment of FIG. 19 resides in the fact that, in order to produce it, it is necessary only to stamp from one side.

The detachment of the card 101 is further facilitated by the fact that the form material is fully stamped through in each case in the four corner zones 106, so that the bridge is restricted to part of the straight sections of the card 101. In addition, a removal aid of the type already described could also be provided in the form of a hole adjoining the card 101, as shown, for example, by FIG. 1.

With regard to processing the forms in printers or the like, for example predominantly in portrait format, the retaining value of the card 101 in the form 100 in the longitudinal and transverse direction can also be set differently by means of a different choice of the cut/web ratio on the longitudinal and the transverse sides of the card 101.

Figure 20:
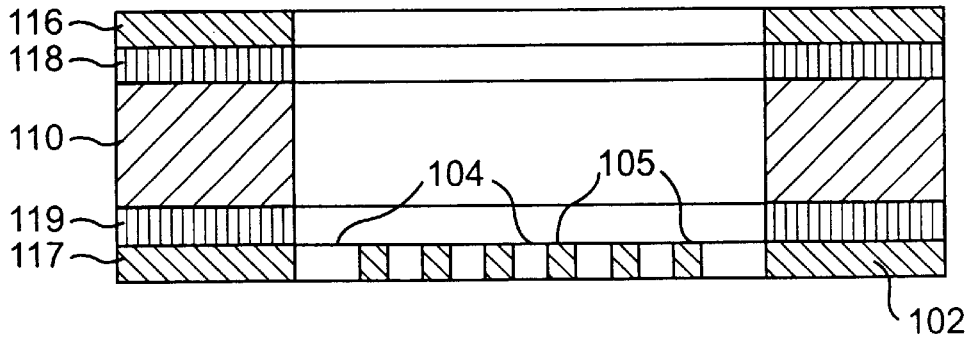
FIG. 20 shows an embodiment corresponding to FIG. 19 in which additional film covering layers are provided.

FIG. 20 shows an embodiment corresponding to FIG. 19, only here the paper layer 110 is further bonded on the front and rear side to foil covering layers 116 and 117. The corresponding contact-adhesive layers are designated by 118 and 119. The part layer 102 forming the bridge is formed here by the lower film layer 117, the bridge once more being intrinsically structured by a cut/web sequence. In spite of the rather unfavorable tearing properties of plastic films, even in the case of this embodiment the card may be detached cleanly from the form, provided only that sufficiently short webs of the order of magnitude of the already mentioned 0.1 mm are used, and the cut/web ratio is about 6:1. The film considered for the film covering layers 116 and 117 is, for example, a biaxially stretched polyester film of 50 $\mu$m thickness.

In order to produce the stampings with differentiated stamping depth that are provided in the embodiments of FIGS. 19 and 20, special sheet-metal punches are necessary. Such a sheet-metal punch 120 is shown, for example, by FIG. 21*a*). In each case only part of the sheet-metal punch 120, with a short section of a stamping web 121, is in each case illustrated in FIG. 21*a*). Said stamping web 121 stands out above the remaining level of the sheet-metal punch 120, in the region of which it are [sic] still just about 0.1 mm thick, has an approximately triangular cross section and is of toothed design. The height of the web 121 is for example 0.44 mm in the region of the teeth 122 and, in the region of the interspaces 123, about half of this, that is to say about 0.22 mm.

Figure 21A:
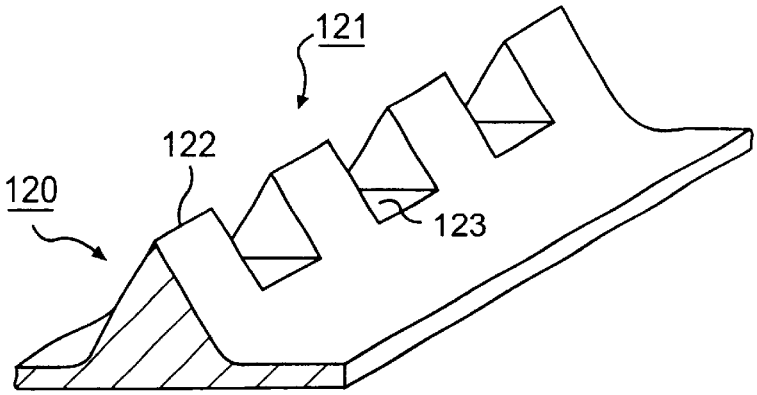
FIG. 21 shows, under a) to c), sheet-metal punches for producing forms of the type of FIG. 19 or [lacuna]

In the case of the sheet-metal punch of FIG. 21*a*), starting from a continuous web 121, the material in the interspaces 123 has been taken away horizontally, which is quite difficult to carry out but still possible, for example by milling, given the mentioned dimensions of the web and the mentioned preferred dimensions of the teeth and the interspaces. However, in this case an actual sharp cutter in the interspaces is lost. By means of a sheet-metal punch 120 designed in this way, the form material, for example in the embodiment of FIG. 19, is more squeezed away and/or compressed than cut in the region of the webs 105, that is to say where it is not completely cut through by the sharp teeth 122, but this has not proven to be critical.

However, in the embodiment of FIG. 20, the rather blunt cutter in the interspaces 123 also readily allows the film covering layer 117 to be stamped a little further at the same time, even in the region of the webs 105, which might be of advantage. Using a sheet-metal punch of the type according to FIG. 21*b*), however, this would also be possible in that in the case of this sheet-metal punch $\mathbf{120}^1$ a cutter is formed even in the interspaces $\mathbf{123}^1$ between the teeth $\mathbf{122}^1$. However, the sheet-metal punch $\mathbf{120}^1$ of FIG. 21*b*) can be produced only with a high outlay.

Figure 21B:
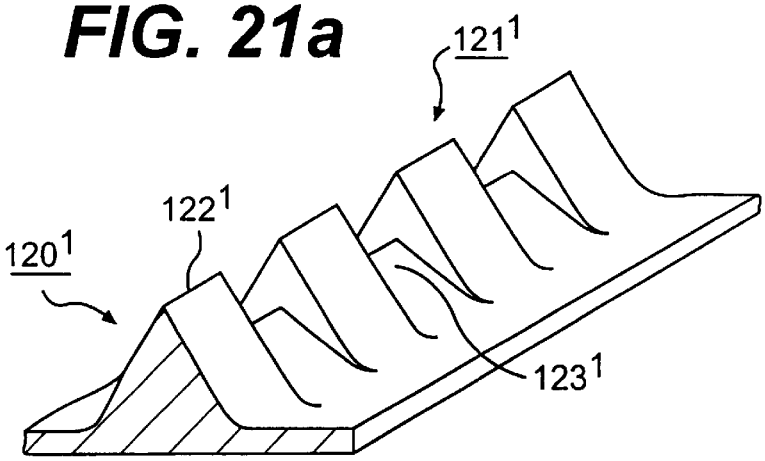
Figure 21C:
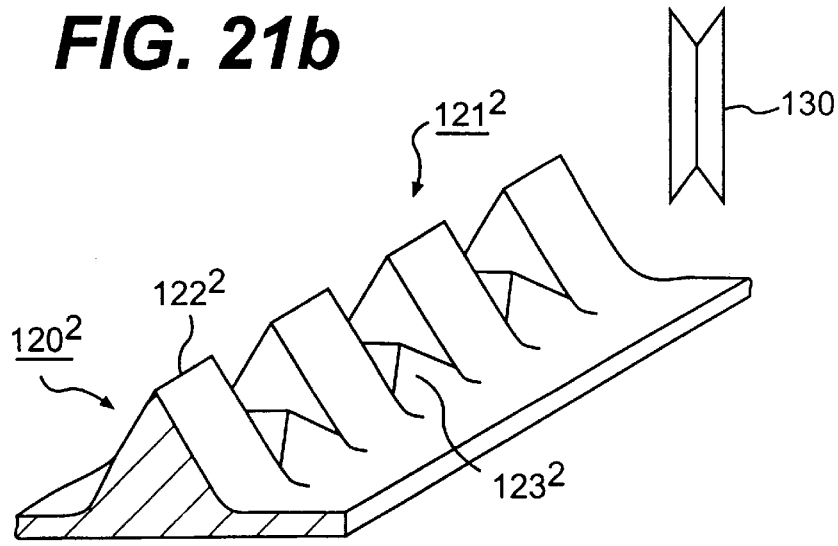

A compromise between the sheet-metal punches of FIG. 21*a*) and FIG. 21*b*) is shown by FIG. 21*c*). In the case of the sheet-metal punch $\mathbf{120}^2$ illustrated here, there is also a cutter in the interspaces $\mathbf{123}^2$ between the teeth $\mathbf{122}^2$, although this cutter also runs transversely with respect to the direction of the stamping web $\mathbf{121}^2$. However, a cutter of this type may once more be produced comparatively simply using a profiled disk mill, as is depicted, for example, in schematic form alongside FIG. 21*c*) and is designated by 130.

Figure 22A:
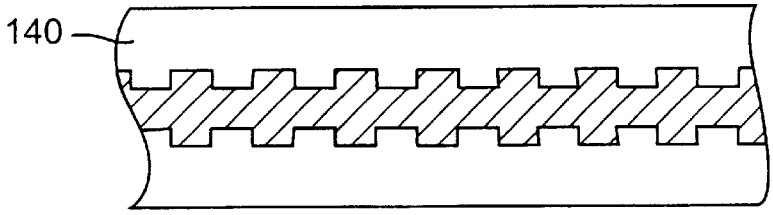
FIG. 22 shows, under a) and b), in each case in section along approximately congruent stamping lines, examples of bridges located on the inside which are structured in the manner of a saw line or perforation.
Figure 22B:
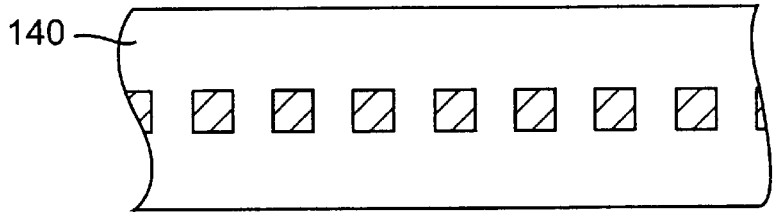

FIG. 22 shows, under a) and b), two cuts corresponding to FIG. 19*b*), only here the bridge is in each case located once more in the interior of a single layer 140 and to this extent, for example, stamping from both sides is necessary for its construction. As in the example of FIG. 19 or 20, the bridge is also inherently structured once more, to be specific in the manner of a saw line in FIG. 22*a*) and in the manner of a perforation in FIG. 22*b*).

Figure 23:
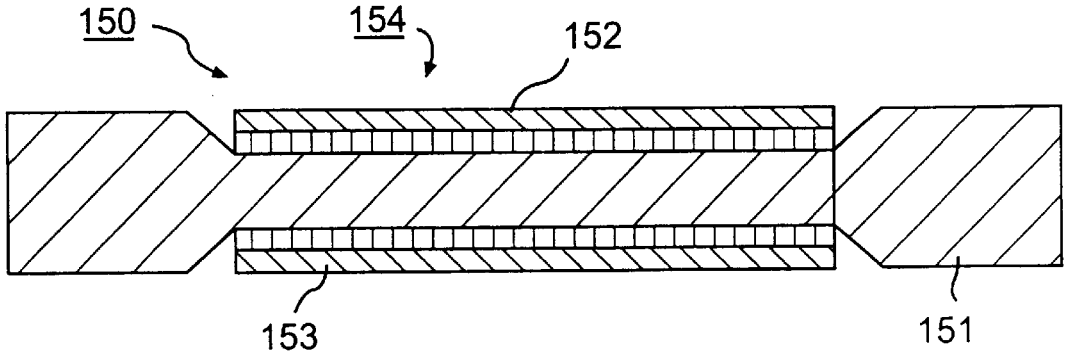
FIG. 23 Shows an embodiment in which the form is pressed together with respect to its thickness in the region of the card.

FIG. 23 shows a further section through a form 150 according to the invention, with a supporting paper layer 151 and foil covering layers 152 and 153 on both sides, these essentially covering only the region of the card 154. The form 150 is now pressed together in the region of the covering layers 152, 153, so that its overall thickness in this region is approximately equal to its thickness outside this region. Such a design is possible, inter alia, because of the advantageous construction of the form according to the invention without using a carrier layer which is not a constituent part of the finished card. Forms according to FIG. 22 may be stacked better than those of a nonuniform thickness.

The pressing together of the form in the region of the covering layers can be carried out in a separate operation, but advantageously directly in conjunction with the stamping, just in the way that squeezing and/or compressing the form material in the region of the stamping webs was already mentioned in the case of stamping using the sheet-metal punch illustrated in FIG. 21*a*). In principle, for example, a device according to FIG. 18 would be suitable for combined stamping and compressing but, with regard, for example, to the embodiments according to FIG. 19 or 20, it would not necessarily be the case that both punches would have to have stamping webs.

The bridge could also be implemented by quite other means. For example, it would be conceivable to introduce an adhesive into the stamped cut during the stamping operation, this adhesive advantageously having a certain brittleness after curing. In this case, it would be possible to stamp through completely from only one side. It is also not necessary to carry out the stamping in the final layer structure. The necessary severing steps could be carried out, for example, previously in individual part layers or groups of part layers, before their lamination. Finally, the embodiments described above are not intended to be final. In particular, it is also possible to use specific features of individual types of embodiment in other types of embodiment.

What is claimed is:

1. A form comprising:

an integrated detachable card having a thickness and an external margin, the external margin forming a card margin;

a material having a thickness surrounding at least a portion of the external margin; and a bridge extending around the external margin and forming a portion of the thickness of the integrated detachable card, the bridge being designed as an intended rupture line between the integrated detachable card and the material, the thickness along the bridge being lower than the thickness of the material.

2. The form according to claim 1, wherein the bridge further comprises at least one of an inner part layer and an outer part layer, and wherein the at least one part layer is severed along the bridge on the card margin.

3. The form according to claim 2, wherein the bridge is formed by a residual thickness between two essentially congruent cutting lines formed from any two sides of the form.

4. The form according to claim 1, wherein the bridge has a web-free design.

5. The form according to claim 2, wherein the bridge has a sawtooth shape.

6. The form according to claim 1, wherein the card includes a self-adhesive label, and wherein a release material is disposed on at least a portion of the label.

7. The form according to claim 6, wherein the bridge is constructed in the release material.

8. The form according to claim 1, further comprising a supporting paper layer, and wherein the bridge is constructed within the paper layer.

9. The form according to claim 1, wherein the material thickness along the bridge is between 10 $\mu$ and 50 $\mu$, but in particular between 15 $\mu$ and 25 $\mu$.

10. The form according to claim 1, further comprising at least one finger hole adjacent to the card margin, for the purpose of facilitating detachment of the card.

11. The form according to claim 1, wherein the card includes a self-adhesive label and wherein a release material is disposed on at least a portion of the label, and wherein the card includes a finger tab to facilitate pulling the release material off the self-adhesive label.

12. The form according to claim 1, wherein the card includes a self-adhesive label, and wherein a release material is disposed on at least a portion of the label, wherein at least one finger hole is provided adjacent to the card margin and a gripping zone is stamped out in the release material adjacent to the finger hole, wherein the rear side of the form is provided with a local release coating in the region of the gripping zone and the stamped portion stamped out in the gripping zone is removed.

13. The form according to claim 12, further comprising a second finger hole disposed adjacent to the card margin for the purpose of facilitating the detachment of the label together with the release material.

14. The form according to claim 1, wherein a release material is bonded onto a portion of the rear side of the form.

15. The form according to claim 1, wherein a release material is bonded onto an entire surface of the rear side of the form.

16. The form according to claim 1, wherein a release material is bonded onto the rear side of the form, and wherein the release material is bonded over an entire surface of the material.

17. The form according to claim 1, wherein a release material is bonded onto the rear side of the form, and wherein the release material is bonded to the material except along a peripheral marginal zone.

18. The form according to claim 17, wherein the release material is a a hot melt adhesive.

19. The form according to claim 1, further comprising at least one film layer bonded to the form.

20. The form according to claim 19, wherein the at least one film layer has a smaller area than the material.

21. A method of producing a form, the form comprising an integrated detachable card having a thickness and an external margin, the external margin forming a card margin, a material having a thickness surrounding at least a portion of the external margin, and a bridge extending around the external margin and forming a portion of the thickness of the integrated detachable card, the bridge being designed as an intended rupture line between the integrated detachable card and the material, the thickness along the bridge being lower than the thickness of the material, the method comprising the step of stamping the form congruently from both sides thereof to form said bridge.

22. The form according to claim 1, wherein a portion of the form is bonded, at least on one side, to at least one of a release material and a film covering layer and wherein the portion of the form bonded to at least one of the release material and the film covering layer has a thickness equal to a portion of the form not bonded to at least one of a release material and a film covering layer.

23. The form according to claim 1, wherein the bridge is formed by an adhesive in a stamped cut.

* * * * *